US008431298B2

(12) United States Patent
Anno et al.

(10) Patent No.: US 8,431,298 B2
(45) Date of Patent: Apr. 30, 2013

(54) TONER AND TONER MANUFACTURING METHOD

(75) Inventors: Masahiro Anno, Tokyo (JP); Masahiko Nakamura, Tokyo (JP); Tsuyoshi Uchida, Tokyo (JP); Kouichi Sugama, Tokyo (JP); Kenichi Onaka, Tokyo (JP); Junya Onishi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 227 days.

(21) Appl. No.: 12/919,937

(22) PCT Filed: Jun. 26, 2009

(86) PCT No.: PCT/JP2009/061712

§ 371 (c)(1),
(2), (4) Date: Aug. 27, 2010

(87) PCT Pub. No.: WO2010/001825

PCT Pub. Date: Jan. 7, 2010

(65) Prior Publication Data

US 2011/0014561 A1 Jan. 20, 2011

(30) Foreign Application Priority Data

Jul. 3, 2008 (JP) ..... 2008-174532

(51) Int. Cl.
*G03G 9/00* (2006.01)

(52) U.S. Cl.
USPC ..... 430/108.5; 430/108.1; 430/109.1; 430/109.4

(58) Field of Classification Search ..... 430/108.1, 430/108.5, 109.1, 109.4, 110.3
See application file for complete search history.

(56) References Cited

U.S. PATENT DOCUMENTS

| | | | | |
|---|---|---|---|---|
| 2006/0292476 | A1 * | 12/2006 | Maehata et al. | 430/109.4 |
| 2008/0176162 | A1 * | 7/2008 | Ohmura et al. | 430/110.3 |
| 2009/0035678 | A1 * | 2/2009 | Yasumura et al. | 430/75 |
| 2009/0042120 | A1 * | 2/2009 | Yasumura et al. | 430/108.5 |

FOREIGN PATENT DOCUMENTS

| | | | |
|---|---|---|---|
| JP | 2003-280266 | A | 10/2003 |
| JP | 2003-295522 | A | 10/2003 |
| JP | 2003295522 | A * | 10/2003 |
| JP | 2004126544 | A | 4/2004 |
| JP | 2005-091525 | A | 4/2005 |
| JP | 2005091696 | A | 4/2005 |
| JP | 2005173570 | A | 6/2005 |

OTHER PUBLICATIONS

English Translation of JP 2003295522A.*

* cited by examiner

*Primary Examiner* — Stewart Fraser
(74) *Attorney, Agent, or Firm* — Lucas & Mercanti, LLP

(57) ABSTRACT

Provided are a toner and a toner manufacturing method with which high image density and a broad range of color reproduction are obtained, and with which high-quality images are also obtained. The toner is composed of toner particles that comprise a binding resin containing a polyester resin and a colorant, and contains 10-1,500 ppm of a metal element selected from titanium, germanium, and aluminum, and a cyclic phenol sulfide represented by general formula (1) selected from thiacalixarene, sulfinyl thiacalixarene and sulfonyl thiacalixarene.

16 Claims, No Drawings

TONER AND TONER MANUFACTURING METHOD

This is a U.S. National Phase Application under 35 U.S.C. 371 of International Application PCT/JP2009/061712, filed on Jun. 26, 2009, which claimed the priority of Japanese application No. 2008-174532, filed Jul. 3, 2008, the entire content of both applications are hereby incorporated by reference.

FIELD OF THE INVENTION

The present invention relates to a toner used for an image forming method of an electrophotographic system and a preparation method thereof.

BACKGROUND OF THE INVENTION

In recent years, electrophotographic image forming apparatuses have been used not only as usual copiers or printers for printing or copying intra-office documents but also in the field of preparation of printed materials for extra-office use, specifically, their use has been expanded to the printing on-demand (POD) market in the area of short-run printing. In the POD market, the image quality is required as high as the graphic arts printing for the formed printing material, since required numbers of printed material having high quality image such as photographic image are printed on demand without print making.

In order to obtain printed material of high image quality required in the POD market, reduction of the toner particle diameter is known to be effective and there have been proposed various chemical toners to achieve this. Such a chemical toner, which is prepared by the process of granulation in an aqueous medium, has an advantage that fine toner particles of high uniformity can be obtained, in contrast to a pulverization method.

As is also known, the use of polyester resin as a binding resin for toner particles is effective to obtain printed material of high image quality with high glossiness, without causing an offset phenomenon in fixing.

There was proposed a method of preparing fine toner particles by using a polyester resin, in which the polyester resin dissolved or dispersed in a solvent, was dispersed in an aqueous medium to form oil-droplets, followed by removal of the solvent to obtain toner particles.

The polyester resin can be synthesized via polycondensation, and catalyser is used in the polycondensation in majority. There are generally used tin compounds such as dibutyl tin as a catalyst used for synthesis of polyester resin through polycondensation, and technologies to synthesizing polyester resin employing the tin compound as a catalyser has been examined. (See, for example, Patent Document 1)

However the method of manufacturing toner particles employing the polyester resin synthesized with tin compound as the catalyser includes one wherein toner particles are manufactured by granulating oil droplets which is formed by dissolving or dispersing the colored particles as well as polyester resin in a solvent to form. The dispersibility of the colored particles in the toner particles obtained by this method has a tendency to deteriorate, and therefore, the toner is disadvantageous to make printed matter having broad color reproduction range.

Further, the tin compounds used as a catalyst are organo-tin compounds having an aliphatic group bonded to metal (tin). Recently, organo-tin compounds may be subjected to regulation to use in view of environmental suitability. The catalyst used to synthesize of polyester resin has been reexamined.

Recently, in view of such environmental consideration, there were proposed titanium catalysts such as titanium halogenate, titanium diketoenolato, titanium carboxylate, titanyl carboxylate and titanyl carboxylate salt; and metal catalysts such as a germanium catalyst and an aluminum catalyst, as disclosed in Patent Documents No. 2 to 4.

The toner employing the polyester synthesized employing the catalysts mentioned above observed tendency to improve charging rise up by virtue of an action of the metal element. On the other side, it becomes difficult to maintain the stability of charging performance due to an effect by metal atom, and it becomes difficult to maintain the charging performance particularly in case that the image is formed under the condition of high temperature and high humidity.

As it becomes difficult to maintain the stability of charging performance due to an effect by metal atom contained in the polyester resin, it becomes difficult to supply a predetermined amount of toner on the surface of the photoreceptor, and consequently, image density or color reproduction is affected. Particularly it concerns about use in for on demand printing which strictly requires density and color hue.

PRIOR ART DOCUMENT

Patent Document

Patent Document 1: JP-A No. 2005-173570

Patent Document 2: JP-A No. 2004-126544

Patent Document 3: JP-A No. 2005-91696

Patent Document 4: JP-A No. 2005-91525

SUMMARY OF THE INVENTION

Problem to Dissolve by the Invention

In view of the foregoing background, the present invention has come into being and it is an object of the invention to provide a toner employing polyester resin as the binding resin which can achieve high image density and broad color reproduction and also realize a high quality image, as well as a manufacturing method of the toner.

Technical Means to Dissolve the Problem

The inventors have found, as a result of examination, that the problem mentioned above is dissolved by that specific amount of metal element selected from titanium, germanium and aluminum, and a specific cyclic phenol sulfide are incorporated in toner particles employing polyester resin as a binding resin.

The present invention is attained by one of the constitutions described below.

The invention described in claim 1 is a toner composed of toner particles containing at least a binding resin containing a polyester resin and a colorant, wherein the toner contains a metal element selected from titanium, germanium and aluminum in a ratio of 10 ppm to 1500 ppm, and cyclic phenol sulfide represented by Formula (1) described below, and the cyclic phenol sulfide described above is any one of thiacalixarene, sulfinyl thiacalixarene and sulfonyl thiacalixarene.

(Chem 1)

Formula (1)

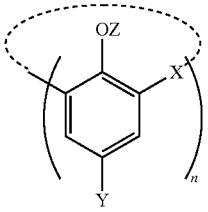

In the formula, X is a sulfur atom, an SO or $SO_2$ group; Z is a hydrogen atom, an alkyl group, a substituted alkyl group, an aralkyl group, an acyl group or an alkoxycarbonyl group; Y is a hydrocarbon group, a halogenated hydrocarbon group, a halogen atom, —$SO_4R^1$ group or —$SO_3R^2$ group, wherein $R^1$ and $R^2$ is a hydrogen atom, a hydrocarbon group or a metal atom, and plural Ys may be same or different; and n is an integer of 3 to 9.

The invention described in claim 2 is the toner described in claim 1, wherein the metal element is contained in a state of dispersion in the binding resin composing toner particles.

The invention described in claim 3 is a toner described in claim 1 or 2, wherein the toner has an average circularity of 0.950 to 0.980, a volume-based median diameter of 4.5 to 8.0 μm and a volume-based particle diameter dispersion degree ($CV_{vol}$ value) of 15 to 25.

The invention described in claim 4 is a manufacturing method of the toner containing at least a binding resin containing polyester resin and a colorant via a process of granulating in an aqueous medium oil droplets formed by dissolving or dispersing at least a polyester segment composing a polyester resin and a colorant in a solvent, wherein the polyester segment composing polyester resin described above is formed by polycondensation of polyalcohol and polycarboxylic acid in the presence of a metal ion selected from titanium, germanium and aluminum, and the toner contains any one of a cyclic phenol sulfide of thiacalixarene, sulfinyl thiacalixarene and sulfonyl thiacalixarene represented by Formula (1) described below.

(Chem 2)

Formula (1)

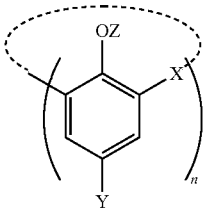

In the formula, X is a sulfur atom, an SO or $SO_2$ group, Z is a hydrogen atom, an alkyl group, a substituted alkyl group, an aralkyl group, an acyl group or an alkoxycarbonyl group. Y is a hydrocarbon group, a halogenated hydrocarbon group, a halogen atom, —$SO_4R^1$ group or —$SO_3R^2$ group, $R^1$ and $R^2$ is a hydrogen atom, a hydrocarbon group or a metal atom, wherein plural Ys may be same or different, and n is an integer of 3 to 9.

Advantage of the Invention

A toner to obtain an image exhibiting high image density, a broad color reproduction area, as well as high image quality and a manufacturing method of the toner can be provided according to the toner the invention. It is assumed that a colorant is becomes exhibiting high dispersibility in the binding resin composed of a polyester resin by incorporating specific metal element in a specific ratio in the toner of the invention, and consequently, high image density and a broad color reproduction area are obtained in a circumstances of reduced electric power consumption and image having high quality can be formed. An adequate charging control action is endowed to the toner, particularly, charging ability can be maintained stably at high temperature and high humidity ambience.

The reason why the above described advantage can be obtained by incorporate the specific metal element in a specific amount in the invention is assumed as follows. In the invention the constitution is adopted, in which a specific amount of the metal element which is used as a catalyser is allowed to remain when the polyester segment is synthesized in the toner manufacture process. In accordance with constitution the remaining metal element is oriented to colorants, as the result, a performance to highly disperse in the polyester resin is given to the colorant, and a state wherein the colorant is homogeneously dispersed in the polyester is formed. It is assumed that as described above, adequate dispersibility is given to the colorant by that specific metal element is orientated to the colorant, whereby the high image density and the broad color reproduction area are obtained as well as an image of high quality can be formed.

Though the reason why good chargeability is displayed by incorporating the compound represented by Formula (1) is not clear, it is assumed as follows. The compound represented by Formula (1) has a cyclic structure so-called thiacalixarene structure, which is formed by any bonding groups of a sulfur atom (S)/a sulfinyl group (SO group),/a sulfonyl group ($SO_2$ group). These bonding groups are liable to form a coordinate structure against a metal, and free state of metal without contributing to dispersion of colorant is taken in the cyclic structure formed by these bonding groups to form a coordinate state. Thus it is assumed as a result that the leak of charge due to metal element existing in a free state is inhibited by the coordination, good chargeability can be maintained stably even in an environment of high temperature and high humidity.

Further according to the toner of the invention an image having higher quality can be obtained by stipulating an average circularity and a volume-based median diameter. Further, existence of toner particles having excessively small particle size or large particle size is inhibited by stipulating the volume-based particle diameter dispersion degree ($CV_{vol}$ value) within a sharp range so that high close adhesion ability between the toner particles at fixing process can be obtained. In addition thereto, distance between toner particles is minimized by giving the specific indeterminate shape to the toner so that high close adhesion ability between the toner particles at fixing process can be obtained and toner scattering is inhibited. Consequently, an image having fine line reproduction as well as high image density can be obtained.

EMBODIMENT TO PRACTISE THE INVENTION

The invention is specifically described.

The toner according to the invention is a toner composed of toner particles containing a binding resin containing a polyester resin and a colorant, wherein the toner contains a metal element selected from titanium, germanium and aluminum in a ratio of not less than 10 ppm and not more than 1500 ppm. And it contains cyclic phenol sulfide represented by Formula (1) described below, wherein the cyclic phenol sulfide described above is any one of thiacalixarene, sulfinyl thiacalixarene and sulfonyl thiacalixarene.

(Chem 3)

Formula (1)

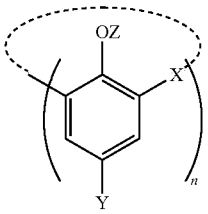

In the formula, X is a sulfur atom, an SO or $SO_2$ group; Z is a hydrogen atom, an alkyl group, a substituted alkyl group, an aralkyl group, an acyl group or an alkoxycarbonyl group; Y is a hydrocarbon group, a halogenated hydrocarbon group, a halogen atom, —$SO_4R^1$ group or —$SO_3R^2$ group, wherein $R^1$ and $R^2$ is a hydrogen atom, a hydrocarbon group or a metal atom, and plural Ys may be same or different; and n is an integer of 3 to 9.

The metal element incorporated in the toner particles composing the toner according to the invention, at first. The toner particles composing the toner according to the invention contain a specific metal element selected from titanium, geranium and aluminum in a ratio of 10 ppm to 1500 ppm.

Content ratio of the metal element is possible to measure generally by a known metal analysis method such as an atomic absorption photometric analysis or plasma emission analysis, and practically, the content ratio of the metal element can be measured by a high frequency plasma emission analyzer on the market "SPS 1200A" manufactured by SEIKO Electronics industrial Co. Ltd.

The specific metal element designated in the invention is one or two or more kinds selected from titanium, germanium and aluminum.

The specific metal element is one having a form of an organic metal compound, a metal oxide compound or the like, and it is preferably incorporated in a form of organic metal compound in particular. It is preferable that the organic metal compound forms a skeleton It is considered that the colorant can obtain sufficiently high dispersibility in the polyester resin when the content ratio of the specific metal element falls within the above described range in the invention. When the metal element is incorporated with excessive level beyond the above describe range, resistivity of the toner reduces and it is liable to generate charge leak due to excess existence of the specific metal, and generation of deterioration is concerned such that reduction of chargeability is liable to occur, particularly when the image is formed in a high temperature and high humidity environmental. On the other side, when the metal element is incorporated with insufficient level under the above describe range, sufficient dispersibility can not be given to the colorant, it becomes impossible to form an image having high image density and a broad color reproduction area.

It is preferable that the metal element is contained in a binding resin composing the above described toner particles in a dispersed state. The dispersibility of the colorant can be highly improved since the metal element becomes a state liable to be oriented to the colorant in the binding resin by that the metal element is contained in a binding resin in a dispersed state as described above. It is assumed that orientation of the metal element and colorant effectively displays, the improvement of image density and broadening of color reproduction area becomes possible. A method of adding the metal element to the binding resin practiced in the invention will be described later.

The compound represented by Formula (1) described above to be incorporated in the toner according to the invention is described.

The toner particles composing the toner according to the invention contain a compound called "cyclic phenol sulfide" represented by Formula (1) described above. The compound represented by Formula (1) forms a cyclic structure by binding n-pieces of substituent X at 2-position and a part at 6-position in benzene rings. The position, to which OZ bonds, is set as 1-position in the benzene ring of the compound represented by Formula (1). The bonding group X to form a bridging portion between 2- and 6-position of the benzene ring is any group of a sulfur atom, an SO or $SO_2$ group.

The group Z in OZ, which bonds to 1-position of the benzene ring composing the compound represented by Formula (1), is a hydrogen atom, an alkyl group, a substituted alkyl group, an aralkyl group, an acyl group or an alkoxycarbonyl group. The compound represented by Formula (1) has a structure, in which, a hydrogen atom or an organic group bonds to the oxygen atom bonding to 1-position and a sulfur atom bonds to 2-position of the benzene ring.

The compound represented by Formula (1) is called "cyclic phenol sulfide" in view of such a structure in the invention. One having a sulfur atom, SO group and $SO_2$ group in X of the Formula is called thiacalixarene, sulfinyl thiacalixarene and sulfonyl thiacalixarene, respectively.

The group Y bonding to 4-position of the benzene ring composing the compound represented by Formula (1) is a hydrocarbon group, a halogenated hydrocarbon group, a halogen atom, or sulfate or sulfite represented by —$SO_4R^1$ or —$SO_3R^2$. $R^1$ and $R^2$ composing the sulfate or sulfite is a hydrogen atom, a hydrocarbon group or a metal atom. The compound represented by Formula (1) has a structure bonding a plurality of benzene rings in cycle, and therefore plural bonding groups Ys are required. The plural Ys composing the compound represented by Formula (1) may be same kind of bonding group or different kind of bonding group.

The hydrocarbon group used in the bonding group Y is described. Known hydrocarbon group can be used for the bonding group Y, examples thereof including a saturated aliphatic hydrocarbon group, an unsaturated aliphatic hydrocarbon group, an alicyclic hydrocarbon group, an alicyclic-aliphatic hydrocarbon group, an aromatic hydrocarbon group and aromatic-aliphatic hydrocarbon group.

Practical examples of the hydrocarbon group includes an alkyl group such as a methyl, ethyl, n-propyl, isopropyl, n-butyl, isobutyl, tert-butyl, n-pentyl, isopentyl, neopentyl, tert-pentyl, 2-methyl butyl, n-hexyl, isohexyl, 3-methyl pentyl, ethyl butyl, n-heptyl, 2-methyl hexyl, n-octyl, isooctyl, tert-octyl, 2-ethyl hexyl, 3-methyl heptyl, n-nonyl, isononyl, 1-methyl octyl, ethyl heptyl, n-decyl, 1-methyl nonyl, n-undecyl, 1,1-dimethyl nonyl, n-dodecyl, n-tetradecyl, n-heptadecyl, and n-octadecyl group, and a hydrocarbon group composed of polymers or their copolymer of ethylene, propylene and butylene.

Practical examples of the unsaturated aliphatic hydrocarbon group includes an alkenyl, or alkinyl group such as a vinyl, allyl, isopropenyl, 2-butenyl, 2-methyl allyl, 1,1-dimethyl allyl, 3-methyl-2-butenyl, 3-methyl-3-butenyl, 4-pentenyl, hexenyl, octenyl, nonenyl, and decenyl group, and polymers or their copolymer of acetylene, butadiene and isopropylene.

Practical examples of the alicyclic hydrocarbon group includes a cycloalkyl group, cycloalkenyl group and cycloalkinyl group such as a cyclopropyl, cyclobutyl, cyclopentyl, cyclohexyl, cycloheptyl, cyclooctyl, 3-methyl cyclohexyl, 4-methyl cyclohexyl, 4-ethyl cyclohexyl, 2-methyl cyclooctyl, cyclopropenyl, cyclobutenyl, cyclopentenyl, cyclohexenyl, cyclooctenyl, 4-methyl cyclohexenyl and 4-ethyl cyclohexenyl group.

Practical examples of the alicyclic-aliphatic hydrocarbon group includes an alkyl, alkenyl and alkinyl group substituted by a cycloalkyl, cycloalkenyl and cycloalkinyl group such as a cyclopropylethyl, cyclobutylethyl, cyclopentylethyl, cyclohexylmethyl, cyclohexylethyl, cycloheptylmethyl, cyclooctylethyl, 3-methyl cyclohexylpropyl, 4-methyl cyclohexylethyl, 4-ethyl cyclohexylethyl, 2-methyl cyclooctylethyl, cyclopropenylbutyl, cyclobutenylethyl, cyclopentenylethyl, cyclohexenylmethyl, cycloheptenylmethyl, cyclooctenylethyl, 4-methyl cyclohexenylpropyl and 4-ethyl cyclohexenylpentyl group.

Practical examples of the aromatic hydrocarbon group includes an aryl group such as a phenyl, and naphthyl group, and an alkylaryl, alkenylaryl, alkinylaryl group such as a 4-methyl phenyl, 3,4-dimethyl phenyl, 3,4,5-trimethyl phenyl, 2-ethyl phenyl, n-butylphenyl, tert-butylphenyl, amylphenyl, hexylphenyl, nonylphenyl, 2-tert-butyl-5-methyl phenyl, cyclohexylphenyl, cresyl, oxyethyl cresyl, 2-methoxy-4-tert-butylphenyl and dodecylphenyl group. An alkyl part of the alkylaryl group, alkenyl part of the alkenylaryl group, and alkinyl part of the alkinylaryl group may form a ring structure.

Practical examples of the aromatic aliphatic hydrocarbon group includes an aralkyl, aralkinyl and aralkyl group, such as a benzyl, 1-phenylethyl, 2-phenylethyl, 2-phenylpropyl, 3-phenylpropyl, 4-phenylbutyl, 5-phenylpentyl, 6-phenylhexyl, 1-(4-methyl phenyl)ethyl, 2-(4-methyl phenyl)ethyl, 2-methyl benzyl, and 1,1-dimethyl-2-phenylethyl group. An alkyl part of aralkyl group, alkenyl part of the aralkyl, and alkinyl part of the aralkinyl may form a ring structure.

The halogenated hydrocarbon group usable as the bonding group Y is preferably one in which the above described hydrocarbon group is substituted by halogen, and the halogen composed of the halogenated hydrocarbon group may be a fluorine, chlorine, bromine or iodine atom.

The halogen atom usable as the bonding group Y may be a fluorine, chlorine, bromine or iodine atom.

The group of $R^1$ and $R^2$ composing sulfate or sulfite represented by —$SO_4R^1$ or —$SO_3R^2$ usable as the bonding group Y is a hydrogen atom, a hydrocarbon group or a metal atom, and the above described hydrocarbon group can be adopted.

The metal atom is not particularly limited and is preferably an alkali metal in case that the group of $R^1$ and $R^2$ is a metal atom, that is, Y is metal sulfate or metal sulfite. The alkali metal includes sodium, potassium, rubidium, cesium and francium and preferable is sodium.

In the Formula (1), n is an integer of 3 to 9, preferably is 4 to 6, and particularly preferably 4.

The cyclic phenol sulfide represented by Formula (1) includes thiacalixarene, sulfinyl thiacalixarene and sulfonyl thiacalixarene having a sulfur atom, an SO group and an $SO_2$ group in X of the Formula, respectively. A manufacturing method of these cyclic sulfides are not particularly restricted and these can be synthesized by combining methods of sulfinylization or sulfonylization described in WO 98/009959 optionally, based on the thiacalixarene and dehydrocarbon method and sulfonylization method described in JP A H09-227553. The inventors of the invention developed a reaction method in which dialkyl and sulfonylization is conducted by one step, (WO99/29683), convenient manufacturing is possible to adopting this method. The cyclic phenol sulfide represented by Formula (1) may be used one kind or two or more kinds in combination.

Specific examples of the cyclic phenol sulfide represented by Formula (1) contained in the toner according to the invention are illustrated. The cyclic phenol sulfide represented by Formula (1) is selected from thiacalixarene, sulfinyl thiacalixarene and sulfonyl thiacalixarene, including those shown in the following Table 1.

TABLE 1

| Compound No. | n | X | Y | Z |
|---|---|---|---|---|
| 1 | 8 | S | Methyl | Methyl |
| 2 | 8 | S | Ethyl | Hydrogen |
| 3 | 8 | S | t-Butyl | Hydrogen |
| 4 | 8 | S | Octyl | Hydrogen |
| 5 | 8 | S | n-Nonyl | Hydrogen |
| 6 | 8 | S | Cyclohexyl | Hydrogen |
| 7 | 8 | S | Perfluoroethyl | Hydrogen |
| 8 | 8 | S | Monochloromethyl | Ethyl |
| 9 | 8 | S | Cl | Hydrogen |
| 10 | 8 | S | Br | Hydrogen |
| 11 | 8 | S | $SO_3H$ | Hydrogen |
| 12 | 8 | S | $SO_4CH_3$ | Hydrogen |
| 13 | 8 | S | $SO_4Na$ | Hydrogen |
| 14 | 8 | SO | Methyl | Methyl |
| 15 | 8 | SO | Ethyl | Hydrogen |
| 16 | 8 | SO | t-Butyl | Hydrogen |
| 17 | 8 | SO | Octyl | Hydrogen |
| 18 | 8 | SO | n-Nonyl | Hydrogen |
| 19 | 8 | SO | Cyclohexyl | Hydrogen |
| 20 | 8 | SO | Perfluoroethyl | Hydrogen |
| 21 | 8 | SO | Monochloromethyl | Ethyl |
| 22 | 8 | SO | Cl | Hydrogen |
| 23 | 8 | SO | Br | Hydrogen |
| 24 | 8 | SO | $SO_3H$ | Hydrogen |
| 25 | 8 | SO | $SO_4CH_3$ | Hydrogen |
| 26 | 8 | SO | $SO_4Na$ | Hydrogen |
| 27 | 8 | $SO_2$ | Methyl | Methyl |
| 28 | 8 | $SO_2$ | Ethyl | Hydrogen |
| 29 | 8 | $SO_2$ | t-Butyl | Hydrogen |
| 30 | 8 | $SO_2$ | Octyl | Hydrogen |
| 31 | 8 | $SO_2$ | n-Nonyl | Hydrogen |
| 32 | 8 | $SO_2$ | Cyclohexyl | Hydrogen |
| 33 | 8 | $SO_2$ | Perfluoroethyl | Hydrogen |
| 34 | 8 | $SO_2$ | Monochloromethyl | Ethyl |
| 35 | 8 | $SO_2$ | Cl | Hydrogen |
| 36 | 8 | $SO_2$ | Br | Hydrogen |
| 37 | 8 | $SO_2$ | $SO_3H$ | Hydrogen |
| 38 | 8 | $SO_2$ | $SO_4CH_3$ | Hydrogen |
| 39 | 8 | $SO_2$ | SO4Na | Hydrogen |
| 40 | 6 | S | t-Butyl | Methyl |
| 41 | 4 | S | Octyl | Hydrogen |
| 42 | 6 | SO | n-Nonyl | Hydrogen |
| 43 | 6 | SO | Cyclohexyl | Hydrogen |
| 44 | 4 | $SO_2$ | $SO_3H$ | Hydrogen |
| 45 | 6 | $SO_2$ | $SO_4CH_3$ | Hydrogen |
| 46 | 6 | S | t-Butyl | Hydrogen |
| 47 | 6 | S | Octyl | Ethyl |
| 48 | 6 | S | t-Butyl | Hydrogen |
| 49 | 4 | S | Octyl | Hydrogen |

Preferable particle diameter and shape of the toner of the invention will be described.

The toner of the invention preferably has an average circularity of 0.950 to 0.980, a volume-based median diameter of 4.5 to 8.0 μm and a volume-based particle diameter dispersion degree ($CV_{vol}$ value) of 15 to 25.

The volume-based median diameter, volume-based particle diameter dispersion degree and an average circularity of the toner will be described in concrete.

It is preferable that the toner of the invention has the volume-based median diameter, is from 4.5 to 8.0 μm. A volume-based median diameter falling within the foregoing range of a volume-based median diameter reduces adhesive particles which fly to the heating member and adhere thereto, often causing offset, and results in an enhanced transfer efficiency, leading to enhanced image quality of halftone images and enhanced image quality of fine lines or dots.

The volume-based median diameter of the toner of the invention can be controlled by stirring speed, stirring time etc., of a coagulating step in the manufacturing method of the toner described later.

The volume-based median diameter of toner can be determined using Coulter Multisizer 3 (produced by Beckmann Coulter Co.), connected to a computer system for data processing (produced by Beckmann Coulter Co.).

The measurement procedure is practically as follows: 0.02 g of toner particles are added to 20 ml of a surfactant solution (for example, a surfactant solution obtained by diluting a surfactant containing neutral detergent with pure water to a factor of 10) and dispersed in an ultrasonic homogenizer to prepare toner dispersion. Using a pipette, the toner dispersion is placed into a beaker containing ISOTON II (produced by Beckman Coulter Co.) within a sample stand, until reaching a measurement concentration of 8%. The measurement particle count number was set to 25,000 to perform measurement. Then aperture diameter of the Multisizer 3 was 50 μm. The measurement range of 1 to 30 μm was divided into 256 portions to determine the frequency number. A particle diameter corresponding to 50% of the volume-integrated fraction from the larger particles was defined as a volume-based median diameter.

Volume-Based Particle Diameter Dispersion Degree ($CV_{vol}$)

The volume-based particle diameter dispersion degree (which is also denoted simply as $CV_{vol}$ value) of the toner of the invention is from 15 to 25, and preferably from 15 to 22.

The volume-based particle diameter dispersion degree ($CV_{vol}$ value) is defined by Formula (x) described below. In Formula (x), the arithmetic average value of volume-based particle diameter is a value calculated for 25,000 particles, which is measured by Coulter Multisizer III (Beckmann Coulter Co.):

$$CV_{vol}\text{ value}(\%)=\{(\text{standard deviation of volume-based particle diameter distribution})/(\text{arithmetic average value of volume-based particle diameter})\}\times 100 \qquad \text{Formula (x)}$$

When the volume-based particle diameter dispersion degree is relatively sharp as from 15 to 25, formation of excessively small toner particles or excessively large particles is inhibited and a high density of toner particles is achieved in fixing, producing prints of enhanced fine line reproducibility and high image density.

Average Circularity

In the toner of the invention, the average circularity of toner particles is in the range of 0.950 to 0.980, and preferably 0.955 to 0.975.

An average circularity falling within the range of 0.950 to 0.980 results in prints of high reproducibility of fine lines and high image density.

It is assumed that conventional toner particles of relatively small sizes are relatively thin so that the coverage rate per particle is low, and spaces between toner particles affect reproducibility of fine lines formed of single-layered toner particles, rendering it difficult to achieve high reproduction of fine lines and high image density. On the other hand, toner particles of an irregular form minimize spaces between particles.

The circularity of toner can be adjusted by controlling removing rate of solvent and so on during manufacturing method of the toner described later.

The circularity of toner particles can be measured and determined using FPIA-2100 (produced by Sysmex Co.). Concretely, toner particles are added into an aqueous surfactant solution, dispersed ultrasonically for 1 min. and subjected to measurement using FPIA-2100. The measurement condition is set to HPF (high power flow) mode and measurement is conducted at an optimum concentration of the HPF detection number of 3,000 to 10,000. The circularity of a particle is determined according to the following Formula (z), circularities of toner particles are summed and divided by the number of total particles to obtain the circularity of the toner particles:

$$\text{Circularity}=\{(\text{circumference of a circle having an area equivalent to the projected area of a particle})/(\text{a circumference of the projected particle})\}. \qquad \text{Formula (z)}$$

Manufacturing method of Toner

Manufacturing method of the toner of the invention is described. The toner of the invention can be manufactured by employing so-called molecular growth of particles in an aqueous medium. Specifically, a toner comprising toner particles containing a binding resin comprised of a polyester resin and a colorant can be manufactured by a process comprising preparing a polyester segment, dispersing or dissolving the polyester segment and the colorant in a solvent to prepare a toner forming material solution, dispersing the solution in an aqueous medium in the form of oil-droplets dispersed in the aqueous medium, and performing granulation from the oil-droplets in the aqueous medium to form the toner composed of toner particles.

The polyester segment is a polyester resin used in the manufacturing the toner, and is a resin having such relatively low molecular weight as a number average molecular weight (Mn) of 2,000 to 100,000 and a weight average molecular weight (Mw) of 3,000 to 100,000 determined by gel permeation chromatography (GPC) of tetrahydrofuran (THF) soluble part.

The polyester segment to form a polyester resin is obtained by polycondensation of a polyol and a polycarboxylic acid in the presence of a specific catalytic metal ion selected from titanium, germanium and aluminum.

The specific catalytic metal ion is supplied to a synthesis reaction system of a polyester segment preferably in the form of a catalyst compound as described above.

More specifically, a manufacturing method of the toner includes, for example, following steps;

(1) Polyester segment synthesis step of synthesizing a polyester segment in the presence of a specific metal ion, (2) Isocyanate-modification step of modifying the polyester segment obtained in the foregoing step (1) with an isocyanate to synthesize an isocyanate-modified polyester segment, (3) Preparation step of a toner forming material composition by adding a cross-linking agent (or molecular elongation agent), a colorant, a cyclic phenol sulfide represented by Formula (1) described above, optionally a wax and a solvent to the isocyanate-modified polyester segment obtained by the step of isocyanate-modification step of modifying the polyester segment (2) to prepare a toner forming composition material, (4) Dispersion step of dispersing the toner forming material solution in an aqueous medium to oil-droplets of the material solution dispersed in the aqueous medium, (5) Molecular elongation step of performing molecular elongation within the droplets to obtain a polyester resin in the oil droplets formed in the dispersion step, (6) Coagulation step of coagulating the polyester resin fine particles formed in the molecular elongation step in the aqueous medium, (7) Solvent removal step of removing the solvent from the coagulated particles obtained by the coagulation step to obtain colored particles composing mother material of the toner particles, (8) Filtration and washing step of filtering off the obtained colored particles in the previous step from the aqueous medium and washing the colored particles to remove a surfactant and the like, (9) Drying step of drying the washed particles in the previous step, and

(10) External additive addition step of adding external additives to the dried colored particles in the previous step to obtain toner particles.

The manufacturing method will be detailed in the following.

(1) Polyester Segment Synthesis Step:

In this step, polyester segment having at least one of a hydroxy group and a carboxyl group is prepared by polycondensation of a polyalcohol and polycarboxylic acid in the presence of specific metal ion. Specifically mixture of a polyol, a polycarboxylic acid and a catalyser compound containing a specific metal element is allowed to exist at a temperature of, for example, 150 to 280° C., preferably 170 to 260° C., and optionally under reduced pressure or removing formed water to form a polyester segment.

A reaction temperature of less than 150° C. retards the reaction and cannot often achieve sufficient solubility of a polycarboxylic acid component in a polyol component. A reaction temperature of more than 280° C. has concerns for decomposition of raw material.

Polyalcohol Component

Aromatic diols are preferred as a polyol component to synthesize a polyester segment. Examples of an aromatic diol include bisphenols such as bisphenol A and bisphenol F, and alkylene oxide adducts of these bisphenols. Specific examples of the alkylene oxide adducts of these bisphenols include ethylene oxide adduct or propylene oxide adduct of these bisphenol. These may be used singly or in combination.

In addition to aromatic diols, there may be added the following aliphatic dials. Examples of the aliphatic diol include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,7-heptane 1,8-octanediol, 1,9-nonanadiol, 1,10-decanediol, 1,4-cyclohexanediol and dipropylene glycol. In that case, an aromatic dial preferably accounts for at least 50% by mass of the total diol component. When an aromatic diol accounts for less than 50% by mass of the total diol component, an appropriate viscoelasticity cannot be obtained, often causing a high temperature offset phenomenon and it is concerned that high-speed fixability cannot be accomplished.

To control a melting point of a polyester resin, there may be added a small amount of an aliphatic polyol having a valence of three or more. Specific examples of the aliphatic polyol having a valence of three or more include glycerin, trimethylol ethane, trimethylol propane, pentaerythritol, and sorbitol.

Polycarboxylic Acid Component

Examples of a polycarboxylic acid component used for synthesis of a polyester segment include aliphatic dicarboxylic acids and acid anhydride and acid chloride thereof. Specific examples of the aliphatic dicarboxylic acid include oxalic acid, malonic acid, succinic acid, glutaric acid, adipic acid, suberic acid, azelaic acid, sebacic acid, pimelic acid, citraconic acid, maleic acid, fumaric acid, itaconic acid, glutaconic acid, isododecylsuccinic acid, isododecenylsuccinic acid, n-dodecylsuccinic acid, n-dodecenylsuccinic acid, n-octylsuccinic acid and n-octenylsuccinic acid.

In addition to the foregoing aliphatic dicarboxylic acids, there may be used aromatic dicarboxylic acids such as phthalic acid, isophthalic acid, terephthalic acid and naphthalenedicarboxylic acid. Further carboxylic acid having a valence of 3 or more, such as trimellitic acid and pyromellitic acid may also be used to control the melt viscosity of a polyester resin. These polycarboxylic acids may be used singly or in combination of two or more.

The ratio of the polyol component to the polycarboxylic acid component, which is a molar ratio of hydroxy group [OH] of a polyol component to carboxyl group [COOH] of a polycarboxylic acid, i.e., [OH]/[COOH], is preferably from 1.5/1 to 1/1.5, and more preferably from 1.2/1 to 1/1.2.

A ratio of polyol to polycarboxylic acid falling within the foregoing range can certainly obtain a polyester segment having the intended molecular weight.

Polyester segment is formed by polycondensation of the polyalcohol and polycarboxylic acid in the presence of a specific metal ion in this step. The metal ion is produced by addition of the catalytic composition mentioned below. The specific catalytic composition generating the metal ion in the reaction system includes an organic metal compound and metal oxide, in particular, an organic metal compound having metal alcoholate skeleton is preferable. Specific examples of the catalytic compositions are listed below.

Specific examples of a titanium compound generating titanium ion as the metal ion include titanium alkoxides such as tetra-n-butyltitanate, tetra(2-ethylhexyl)titanate, tetraisopropyltitanate, tetramethyltitanate and tetrastearyl titanate; titanium acrylate such as polyhydroxytitanium stearate; titanium chelates such as titanium tetraacetylacetonato, titanium octylene glycolate, titanium ethylacetoacetate, titanium lactate and titanium triethanolaminate.

Germanium compounds generating germanium include germanium dioxide. Aluminum compounds generating aluminum ion include an oxide such as poly(aluminum hydroxide) and an aluminum alkoxide, and further include tributylaluminate, trioctylaluminate and tristearylaluminate. These may be used singly or in combination.

The foregoing catalyst compound is used preferably in an amount of 0.01 to 1.00% by mass of the total of a polyol component and a polycarboxylic acid.

The catalyst compound may be added at the start of or in the course of polycondensation reaction.

Supplemental addition of the catalyst compound in the course of polycondensation can control the content of a specific metal element of the obtained toner.

The physical property of the polyester segment as formed by the method is described. The glass transition point (Tg) of the obtained polyester segment is preferably from 20 to 90° C., and particularly 35 to 65° C. is preferable.

The softening point of a polyester segment is preferably from SO to 220° C. and more preferably from 80 to 150° C.

The measurement of the glass transition point (Tg) is conducted as follows. A toner of 4.5 mg is precisely weighed, sealed into an aluminum pan (KIT NO. 0219-0041) and set into a DSC-7 sample holder. An empty aluminum pan is used as a reference. The temperature was controlled through a mode of heat-cool-heat at a temperature-raising rate of 10° C./min and a temperature-lowering rate of 10° C./min in the range of 0 to 200° C. An extension line from the base-line prior to the initial rise of the first endothermic peak and a tangent line exhibiting the maximum slope between the initial rise and the peak are drawn and the intersection of both lines is defined as the glass transition point (Tg). The 1st heat was maintained at 200° C. for 5 min.

The softening point is measured as follows. First, under an environment of 20° C. and 50% RH, 1.1 g of a polyester segment is placed into a Petri dish, leveled, allowed to stand for at least 12 hrs., and compressed under a pressure of 3820 kg/cm$^2$ for 30 sec. by using a molding machine SSP-10A produced by Shimadzu Corp. to prepare a cylindrical molded sample of 1 cm diameter. Subsequently, the molded sample is extruded by using a piston of 1 cm diameter through a hole (1 mm diameter×1 mm) under an environment of 24° C. and 50% RH by using a flow test CFT-500D (produced by Shimadzu Corp.) under conditions of a load of 196 N (20 kgf), a start temperature of 60° C., a pre-heating time of 300 sec. and a temperature increasing rate of 6° C./min. An offset method temperature T which is measured at an offset value of 5 mm in a melting temperature measurement of a temperature raising method is defined as the softening point.

The obtained polyester segment preferably exhibits a number average molecular weight (Mn) of 2,000 to 10,000 (more preferably 2,500 to 8,000) and a weight average molecular weight (Mw) of 3,000 to 100,000 (more preferably 4,000 to 70,000), which are determined by gel permeation chromatography (GPC) of tetrahydrofuran (THF) soluble part.

Measurement of molecular weight by GPC can be conducted as follows. Using an apparatus HLC-8220 (produced by TOSOH CORP.) and a column TSK guard column+TSK gel Super HZM-M 3 series (produced by TOSOH CORP.), THF as a carrier solvent is fed at a flow rate of 0.2 ml/min, while maintaining a column temperature of 40° C. A sample is dissolved in THF at room temperature so as to have a concentration of 1 mg/ml, while dispersing for 5 min. by using an ultrasonic dispersing machine.

Then sample solution is obtained by filtered by a membrane filter of 0.2 μm pore size to obtain a sample solution. And then, 10 μl of this sample solution is injected with carrier gas into the GPC and is detected by a refractive index detector (RI detector). In the molecular weight measurement of a sample, the molecular weight distribution of the sample is calculated using a calibration curve prepared by using monodisperse polystyrene standard particles.

The standard polystyrene samples are used those produced by Pressure Chemicals Co., having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. At least about 10 points are used for the calibration curve of polystyrene. A refractive index detector is used as a detector.

(2) Isocyanate-Modification Step:

In this step, a polyvalent isocyanate compound is reacted with a polyester segment synthesized in the foregoing step (1) to substitute a hydroxyl group and/or a carboxyl group at the molecular end of the polyester segment by an isocyanate group to obtain an isocyanate-modified polyester segment. In the reaction of a polyisocyanate compound, there may be used inert solvents for the polyisocyanate compound. Examples of such solvents include ketones such as acetone, methyl ethyl ketone, and methyl isobutyl ketone; esters such as ethyl acetate; amides such as dimethyl formamide and dimethyl acetamide; ethers such as tetrahydrofuran; aromatic solvents such as toluene and xylene.

Polyisocyanate Compound

Examples of a polyisocyanate compound used for isocyanate-modification of a polyester segment include, for example, the following compounds. Aliphatic polyisocyanate compounds such as tetramethylenediisocyanate, hexamethylenediisocyanate and 2,6-diisocyanatomethylcaproate; alicyclic polyisocyanate compounds such as isophoronediisocyanate and cyclohexylmethanediisocyanate; aromatic diisocyanate compounds such as tolylenediisocyanate and diphenylmethanediisocyanate; aroma-aliphatic diisocyanate compounds such as α,α,α',α'-tetramethylxylilenediisocyanate, isocyanurates; phenol derivatives of these polyisocyanate compounds and oxime- or caprolactam-blocked polyisocyanate compounds.

These polyisocyanate compounds may be used singly or in combination.

(3) Preparation of a Toner Forming Material Solution:

In this step, toner constituting materials constituted of an isocyanate-modified polyester segment as obtained by Isocyanate-modification step (2) described above, a cross-linking agent (or molecular elongation agent), a colorant, a cyclic phenol sulfide represented by Formula (1) described above, optionally a wax and so on are dissolved or dispersed in an organic solvent to prepare a toner forming material solution.

The cross-linking agent (or molecular elongation agent), representatively an amine cross-linking agent, is caused to be a composition of polyester resin as a binding resin by reacting with the isocyanate modified polyester segment in the next step. The polyester segment contained in the toner forming material solution is not limited to an isocyanate-modified polyester segment but used in combination therewith may be an unmodified polyester segment.

Organic solvents usable for preparation of the toner forming material composition are preferably those exhibiting a low boiling point in view of removing process after forming colored particles, and low solubility in water. Specific examples of such organic solvents include methyl acetate, ethyl acetate, methyl ethyl ketone, methyl isobutyl ketone, toluene and xylene, which may be used singly or in combination. Such an organic solvent is used preferably in an amount of 1 to 300 parts by mass, more preferably 1 to 100 parts by mass, and still more preferably 25 to 70 parts by mass, based on 100 parts by mass of an isocyanate-modified polyester segment.

An amine cross-linking agent, one of the examples of the cross-linking agent (or molecular elongation agent) and a colorant which can be used in the preparation step of the toner forming material composition are described.

Amine Cross-Linking Agent

Specific examples of an amine cross-linking agent, representative examples of the cross-linking agent, capable of adding to toner forming material composition, include diamines, three or more valent polyvalent amines, aminoalcohols, amine mercaptans and aminoblock compounds.

The specific examples of the diamines include aromatic diamines, alicyclic diamines and aliphatic diamines, described below.

(a) Aromatic diamines such as phenylenediamine, diethyltoluenediamine and 4,4'-diaminodiphenylmethane.

(b) Alicyclic diamines such as 4,4'-diamino-3,3'-dimethyldi cyclohexylmethane, diaminecyclohexane and isophoronediamine.

(c) Aliphatic diamines such as ethylenediamine, tetramethylenediamine, and hexamethylenediamine.

Three or more valent polyvalent amines include diethylenetriamine, and triethylenetetramine. Aminoalcohols include ethanol amine and hydroxyethylaniline. Aminomercaptanes include aminoethylmercaptane and aminopropylmercaptane. Amino acids include aminopropionic acid and aminocapronic acid.

The amino-blocked compounds are formed by dehydration condensation reaction of the amine compounds described above with a carbonyl compound, and examples thereof include a ketimine compound obtained by reaction with a ketone such as acetone, methyl ethyl ketone or methyl isobutyl ketone and an oxazolidine compound.

These amine cross-linking agents may be used singly or in combination.

In the invention, diamine compounds are preferably used as an amine cross-linking agent and to control the melt viscosity of a polyester resin, a diamine compound may be used in combination with a small amount of a polyamine having an amine valence of three or more. This is because it is effective to ensure uniform charging of the toner by minimizing an unreacted amino-end group remained in the obtained polyester resin.

The molecular weight of the obtained polyester resin can be controlled optionally by the use of monoamine compounds or ketimine compounds formed by blocking monoamine compound, which compounds work as elongation-terminating agent. Examples of such an elongation-terminating agent include monoamines such as diethylamine, dibutylamine, butylamine and laurylamine and ketimine compound obtained by blocking these compounds with ketone.

The toner forming material composition contains an amine cross-linking agent preferably in amount of 0.1 to 5 parts by mass, based on 100 parts by mass.

Colorant

As colorants constituting the toner of the invention usable are conventional colorants such as black colorants, magenta or red colorants, orange or yellow colorants and green or cyan colorants.

These colorants may be used singly or in their combination. The colorants subjected to surface treatment with a coupling agent and so on may be usable.

The adding amount of these colorants are preferably in a range of 1 to 30% by mass, and more preferably 2 to 20% by mass, based on total toner, and mixture thereof can be used. Number average primary particle diameter is various depending on the kinds and preferably 10 to 200 nm in general.

The toner forming material solution contains a colorant preferably in an amount of 1 to 15% by mass, and more preferably 4 to 10% by mass, based on total solids.

Wax can be optionally added to the toner forming material composition as required. Various conventionally known waxes are usable in the toner forming material composition. Specific examples thereof include hydrocarbon wax such as low molecular weight polyethylene wax, low molecular weight polypropylene wax, Fischer-Tropsch wax, microcrystalline wax and paraffin wax; ester waxes such as Carnauba wax, pentaerythritol behenic acid ester and behenyl citrate. These are used singly or in their combination.

Charge controlling agents are optionally added to the toner forming material composition as required. Various conventionally known charge controlling agents are usable in the toner forming material composition. Specific examples thereof include a Nigrosine dye, metal salts of naphthenic acid of higher fatty acid, alkoxylated amines, quaternary ammonium salt compounds, azo-type metal complexes, and a salicylic acid metal salt and its complexes.

The toner forming material solution contains a wax preferably in an amount of 2 to 20% by mass, and more preferably 3 to 18% by mass, based on total solids in case that the wax is added to the toner forming material composition. The toner forming material solution contains a charge controlling agent preferably in an amount of 0.1 to 2.5% by mass, and more preferably 0.5 to 2.0% by mass, based on total solids in case that the charge controlling agent is added to the toner forming material composition.

(4) Dispersion Step:

In this step, the toner forming material solution obtained in the foregoing step (3) is added to an aqueous medium and dispersed therein to form oil-droplets. Particle diameter of the droplets is controlled so as to obtain toner mother particles of a targeted particle diameter when the oil droplets are formed.

Dispersion of the toner forming material composition into aqueous medium can be conducted by employing mechanical energy. Dispersing machines to perform dispersion are not specifically limited but examples thereof include a low-speed shearing dispersing machine, a high-speed shearing dispersing machine, a friction-type dispersing machine, a high-pressure jet dispersing machine and an ultrasonic dispersing machine. Example of a dispersion machine obtainable in the market is "TK type Homomixer" (produced by Tokushu Kika Kogyo Co., Ltd.).

The number average primary particle diameter of oil-droplets is preferably from 60 to 1,000 nm, and more preferably from 80 to 500 nm. The number average primary particle diameter of oil-droplets can be determined via an electrophoretic light scattering photometer ELS-800 (produced by Otsuka Electronics Co., Ltd.).

The aqueous medium refers to a medium containing water in an amount of at least 50% by mass. As components other than water is cited water-soluble organic solvents and examples thereof include methanol, ethanol, isopropanol, butanol, acetone, methyl ethyl ketone, dimethylformamide, methyl cellosolve and tetrahydrofuran. Of these solvents, it is preferred to use alcoholic organic solvents which do not dissolve a resin, for example, methanol, ethanol, isopropanol and butanol.

The amount of the aqueous medium is preferably from 50 to 2,000 parts by mass and more preferably from 100 to 1,000 parts by mass, based on 100 parts by mass of a toner forming material solution. An amount of the aqueous medium, falling within the foregoing range can achieve dispersion of the toner forming material composition in the aqueous medium.

A dispersion stabilizer is dissolved in the aqueous medium. Further, surfactants may be also added to the aqueous medium to achieve enhanced dispersion stability of oil-droplets.

Examples of a dispersion stabilizer include inorganic compounds such as tricalcium phosphate, calcium carbonate, titanium oxide, colloidal silica and hydroxy-apatite. Of these, an acid- or alkali-soluble dispersion stabilizer such as tricaleium phosphate is preferred in terms of necessity of removing the dispersion stabilized from the obtained colored particles and the use of an enzyme-degradable one is preferred in terms of environment concern.

Exemplary surfactants include those as follow. Anionic surfactants such as alkylbenzenesulfonate, α-olefin sulfonate, and phosphoric acid ester; cationic surfactants including an amine salt type such as an alkylamine salt, an aminoalcohol fatty acid derivative, and a polyamine fatty acid derivative; a quaternary ammonium alt type such as an alkyltrimethylammonium, a dialkyldimethylammonium salt, an alkyldimethylbenzyl ammonium salt, a pyridinium salt, an alkylisoquinolinium salt and benzetonium chloride; nonionic surfactants such as a fatty acid amide derivative, a polyol derivative; amphoteric surfactants such as alanine, dodecyl-di-(aminoethyl)glycine, di(octylaminoethyl)glycine and N-alkyl-N,N-dimethylammonium betaine. Anionic or cationic, fluoroalkyl-containing surfactants are also usable.

(5) Molecular Elongation Step:

In this step, polyester resin is formed by molecular elongation within the oil-droplets dispersed in the aqueous medium foamed in the step (4). An isocyanate group of an isocyanate-modified polyester segment is allowed to react with an amine crosslinking agent through crosslinking reaction to form a urea bond, whereby molecular elongation is performed and a urea-modified polyester resin is produced. Thus, this step produces polyester resin, and polyester resin particles containing those added to the toner forming material composition such as a colorant.

The crosslinking reaction time via an amine crosslinking agent (or molecular elongation time), depending on the kind of raw material and the amine crosslinking agent, is preferably 1 to 24 hrs. and more preferably 2 to 15 hrs. The reaction temperature is preferably 20 to 100° C., and more preferably 50 to 98° C.

Dispersion property of the cyclic phenol sulfide represented by Formula (1) is improved and charging performance is stabilised more, by virtue that polyester resin contains urea bond particularly. Though the reason is not clear, it is assumed that interaction between nitrogen atom composing urea bond and linking group (S, SO, and $SO_2$), that is, a group represented by X in the Formula (1) composing cyclic structure of the compound represented by Formula (1). The compound represented by the Formula (1) becomes easier to disperse in the polyester resin to contribute the stability of charging performance as the result.

In the steps (3) to (5), an amine crosslinking agent is preliminarily contained in oil-droplets dispersed in the aqueous medium. Alternatively, an amine crosslinking agent is not preliminarily contained in the toner forming material composition and after dispersing the toner forming material composition in an aqueous medium to form oil-droplets, an amine crosslinking agent may be added to the aqueous medium. In that case, the amine crosslinking agent is supplied from the aqueous medium to the oil-droplets, in which an isocyanate group of an isocyanate-modified polyester is reacted with the amine crosslinking agent to undergo crosslinking reaction to form a urea bond, whereby a urea-modified polyester resin is produced.

(6) Coagulation Step:

In this step, polyester resin microparticles formed in the molecular elongation step (5) are allowed to coagulate in the aqueous medium. Specifically, it is required that the dispersion stability of dispersed particles is lowered to cause coagulation. Methods for causing coagulation of the particles are not specifically limited but it is possible to lower dispersion stability by a method of raising the temperature, a method of adding a coagulant to an aqueous medium, and so on.

Of these methods, the method to raise the temperature of the dispersion state to reduce the dispersion stability is simpler and therefore preferred. In the method, the temperature causing coagulation is not specifically limited but typically from 50 to 98° C., and preferably from 60 to 90° C. In this step, coagulation is grown up in addition to coagulation of the particles. The duration of is not specifically limited so long as it is a time to reach the targeted particle diameter. It is preferably from 1 to 10 hrs, and preferably from 2 to 8 hrs. The particle diameter of the coagulated particles is acceptable as it is required to form toner mother particles finally.

It is possible to concurrently performed molecular elongation in the step (5) and coagulation of polyester microparticles in the step (6).

After completion of the coagulation step, it is preferred to conduct a treatment for shape control. In the shape control treatment, a dispersion of colored particles obtained in the step (6) is subjected to passage through a micrometer-order filter or a treatment of stirring in an annular type continuous-stirring mill etc., to perform shape control so that the major/minor axis ratio falls within the prescribed range.

Specific methods for shape control of colored particles include passage through a gap, a filter or fine pores and centrifugal force applied to colored particles through high-speed rotation. Examples of a device for shape control treatment of colored particles include a piston type high-pressure homogenizer and an in-line screw pump as well as an annular type continuous-stirring mill, as described above.

Toner mother particles of an intended shape can be realized by controlling the treatment time, the treatment temperature and the treatment speed of the shape control treatment. Thus, shape control of colored particles is conducted to produce colored particles of a major/minor axis ratio falling within a prescribed range.

(7) Solvent Removal Step:

This step is removal of the organic solvent from the colored particles obtained in the step (6) to form colored particles composing toner mother particles. In this step, heating to a temperature higher than the boiling point of the organic solvent is conducted to remove the organic solvent. The surface property of the formed particles can be regulated by control of the solvent removing rate. Specifically, increasing the solvent removal rate forms a rugged surface, resulting in enhanced irregularity.

Specifically, heating at a temperature higher than the boiling point of the solvent in the solvent removal step, preferably at a temperature of the boiling point plus 5 to 20° C. and further under reduced pressure of, for example, 1 to 300 hPa can form the rugged surface. Excessively heating cannot achieve the targeted surface property. Similarly, reduced pressure not falling within the foregoing range renders it difficult to fall within the range of the invention.

Even when organic solvents are removed, the presence of a specific catalytic metal ion or a specific catalytic metal compound inhibits colorant aggregation, whereby the colorant is contained in a polyester resin with maintaining a high dispersion state to produce a toner achieving high dispersion of the colorant (8) Filtration and Washing Step:

In the filtration and washing step, a colored particle dispersion obtained in the step (7) is separated by filtration from the aqueous medium, and surfactant etc. are removed from the colored particles by washing. In the filtration and washing step, a colored particle dispersion is subjected to a filtration treatment in which the colored particle dispersion is filtered for solid-liquid separation to separate the colored particles from the dispersion and a washing treatment to remove adhered materials such a surfactant from the separated colored particles. Specific methods for solid-liquid separation and washing include, for example, centrifugal separation, filtration under reduced pressure by using Buchner's funnel and filtration using a filter press.

(9) Drying Step:

In this step, the colored particles having been washed in the step (8) are subjected to a drying treatment. Drying machines usable in this drying step include, for example, a spray dryer, a vacuum freeze dryer, a vacuum dryer, a standing plate type dryer, a mobile plate type dryer, a fluidized-bed dryer, a rotary dryer and a stirring dryer. The moisture content of the thus dried colored particles is preferably not more than 5% by mass, and more preferably not more than 2% by mass.

The moisture content of colored particles is determined by Karl Fischer coulometric titration. Specifically, using an automatic heat-vaporization moisture measurement system AQS-724 (produced by Hiranuma Sangyo Corp.) constituted of a moisture meter AO-6, AQI-601 (interface for AQ-6) and a heat-vaporization device LE-24S, 0.5 g of colored particles which has been allowed to stand in an atmosphere of 20° C. and 50% RH for 24 hrs. is precisely weighed and placed into a 20 ml glass tube and sealed with Teflon®-coated silicone rubber packing. The moisture content under the sealed environment is measured using reagents under the conditions described below. Two empty sample tubes are concurrently measured to correct the moisture content under the sealed environment.

Sample heating temperature: 110° C.

Sample heating time: 1 min.

Nitrogen gas flow rate: 150 ml/min

Reagent:

Opposing electrode liquid (cathode liquid);

HYDRANAL (R)—Coulomat CG-K

Generating liquid (anode liquid);

HYDRANAL (R)—Coulomat AK

In cases when the dried colored particles are aggregated due to a weak attractive force between particles, the aggregate may be disintegrated by using a disintegrating device, such as a jet mill, a Henschel mixer, a coffee mil or a food processor.

(10) External Additive Addition Step:

In the External additive addition step external additives are added to the colored particles subjected to drying treatment in the step (9) to form toner particles. In this step, various organic or inorganic microparticles and a lubricant are incorporated to the dried colored particles to improve fluidity or an electrostatic property and to enhance cleaning capability. Examples of a device used for adding external additives include a turbulent mixer, a Henschel mixer, a NAUTA Mixer or a V-type mixer.

For instance, inorganic particles of silica, titania or alumina are preferably used for the external additive. It is also preferable that these inorganic particles are subjected to a treatment for hydrophobicity, using a silane coupling agent or a titanium coupling agent.

External additives are incorporated preferably in an amount of 0.1 to 5.0% by mass of the toner, and more preferably 0.5 to 4.0% by mass. External additives may be used singly or in combination.

The toner of the invention can be manufactured by the above described procedure.

The polyester resin contained in the binding resin constituting the toner according to the invention is described. The acid value of a polyester resin constituting the toner according to the invention is preferably from 5 to 45 mg KOH/g and more preferably from 5 to 30 mg KOH/g. A polyester resin exhibiting the acid value fallen within the above described range is hardly subject to environmental effects when the image formation operation is conducted under high temperature and high humidity, or low temperature and low humidity, and there is no concern of causing deterioration of the formed images.

The glass transition point (Tg) of a polyester resin is preferably from 30 to 60° C., and more preferably from 35 to 54° C. The softening point is preferably from 70 to 130° C. and more preferably from 80 to 120° C.

The glass transition point (Tg) and the softening point are measured using a toner as a sample, similarly to the manner as described earlier in the measurement of glass transition point and the softening point for polyester segment.

The weight average molecular weight of a polyester resin is preferably from 5,000 to 500,000, and more preferably from 10,000 to 100,000. The number average molecular weight of a polyester resin is preferably from 3,500 to 400,000, and more preferably from 7,000 to 80,000. When a molecular weight of a polyester resin falls within the foregoing range, sufficient low temperature fixability and superior adhesion onto a recording material can be obtained. Further, crushing of toner particles inside a development device is inhibited, and further, enhanced strength of a fixed image is achieved.

When a molecular weight of a polyester resin falls within the foregoing range, adequate melt viscosity displays and good fixing performance is obtained, and the fixed image can be adhered to the recording material fixedly. Further adequate strength is endows to the toner particles as themselves, and crushing of toner particles due to stress by stirring or conveying inside a development device is inhibited, and further strength of the formed fixed image is ensured.

The molecular weight of the polyester resin is measured using a toner as a sample, similarly to the manner as described earlier in the measurement of molecular weight of the polyester segment.

It is assumed that negative electrostatic-charging capability held the polyester resin is reduced due to a urea bonding, because a binding resin is comprised of a polyester resin having urea bond. It is also assumed that excessive-charging is inhibited and enhanced charging stability is achieved as the result, and also superior adhesion onto the recording material is also realized to form a strong toner image. Formation of ester bonding and urea bonding in the molecule results in enhanced internal cohesion, which leads to improved crushing resistance even when it is subjected to stress.

A developer using the toner according to the invention is described. The toner of the invention can be used as a single-component developer by incorporating a magnetic material or as a two-component developer by mixing a so-called carrier, a nonmagnetic single component toner.

When using the toner as a two-component developer by mixing a carrier, toner filming (carrier staining) onto the carrier is inhibited, and when using the toner as a single-component developer, toner filming occurring in a frictionally charging member of a development device is inhibited.

There are usable conventionally known materials can be used as a carrier constituting a two-component developer, including, for example, metals such as iron, ferrite and magnetite, and alloys of metals such as aluminum or lead. Of these, ferrite particles are preferred.

The volume-average particle diameter of a carrier is preferably from 15 to 100 μm, and more preferably 25 to 60 μm. The volume-average particle diameter of the carrier can be determined using a laser diffraction type particle diameter distribution measurement apparatus provided with a wet disperser, HELOS (produced by SYMPATEC GmbH.).

Preferred carriers include resin-coated carrier in which the surface of magnetic particles is covered with resin and a resin dispersion type carrier in which magnetic particles are dispersed in resin. Resins constituting the resin coated carrier are not specifically limited but an olefin resin, a styrene resin, a styrene/acryl resin, a silicone resin, an ester resin, or a fluorine-containing polymer resin is usable.

Resins constituting the resin dispersion type carrier are not specifically limited. Specifically a styrene/acryl resin, a polyester resin, a fluoro resin, or a phenol resin is usable.

Image Forming Method

The image forming method using the toner of the invention will be described. The toner described above is suitable in an image forming method including a fixing step by a contact heating system. In this image forming method, an electrostatic latent image which has been electrostatically formed on an image bearing body is developed by allowing the developer to be electrostatically charged by a frictional-charging member in a developing device to obtain a toner image and the obtained toner image is transferred onto a recording material, thereafter, the transferred toner image is onto the recording material fixed by a contact-heating system to obtain a printed matter.

Fixing

As a suitable fixing method used in the image forming method as described above is cited a so-called contact heating system. Specific examples of such a contact heating system include a thermo-pressure fixing system, a heated roll fixing system and a pressure heat-fixing system in which fixing is performed by a fixed rotatable pressure member enclosing a heating body.

A fixing method of a heated roll fixing system employs a fixing device constituted of a upper roller formed of a fluororesin-coated metal cylinder comprised of iron or aluminum and having a heat s source built-in and a lower roller formed of silicone rubber.

As a heat source is used a linear heater, which heats the upper roller surface to a temperature of 120 to 200° C. Pressure is applied between the upper and lower rollers and the pressure deforms the lower roller, whereby a nip is formed in the deformed portion. The nip depth is usually from 1 to 10 mm and preferably from 1.5 to 7 mm. The linear fixing speed is preferably from 40 to 600 mm/sec. Taking the small nip depth fallen within the above described range, the toner is heated uniformly with high efficiency to conduct print making efficiently without fixing unevenness. Further there is no concern to promote melting of the polyester resin contained in the toner, resulting in fixing offset.

In the toner described above, a high quality image can be obtained as well as higher image density and broader color reproduction range are achieved by the invention. It is assumed that, in the invention, colorant exhibits high dispersibility in the binding resin whereby the toner comprising homogeneously dispersed colorant is obtained by virtue of incorporating the specific metal atom used as a catalyser for synthesizing polyester segment in the toner particles. It is assumed that higher image density and broader color reproduction are realized by an action of uniform dispersion of the colorant and high quality image can be formed when print is formed as the result.

Further the toner of the invention exhibits good charging performance at high temperature and high humidity condition by incorporating a compound represented by Formula (1). It is assumed that a bonding group containing a sulfur atom composing a cyclic structure called thiacalixarene structure of a compound represented by Formula (1) forms coordinate structure with above-described metal element and hinders excess metal element adequately. It is assumed that leak characteristic of the metal element which does not contribute improving dispersion performance of the colorant is retarded, and it realize maintaining good charging performance at high temperature and high humidity, as the result.

Embodiments of the invention have been described but are not limited to these and various changes and modification can be made therein.

EXAMPLES

The invention will be further described with reference to examples but is by no means limited to these.

1. Synthesis of Polyester Segment and Isocyanate-Modified Polyester Segment

Synthesis of Polyester Segment (a1):

Into a reaction vessel fitted with a stirrer and a nitrogen-introducing tube were placed 724 parts by mass of bisphenol A with 2 mole ethylene oxide adduct, 200 parts by mass of isophthalic acid, 70 parts by mass of fumaric acid and 2 parts by mass (0.2% by mass) of tetra-n-butyl titanate and reacted at 220° C. under normal pressure for 7 hrs. Further, after reacted under reduced pressure of 1,330 Pa for 4 hrs., the reaction mixture was cooled to 160° C.

Then, 32 parts by mass of phthalic acid anhydride was added thereto and reacted for 2 hrs. to obtain a polyester segment (a1). The polyester segment (a1) exhibited a glass transition point (Tg) of 52° C., a softening point of 108° C., a number average molecular weight (Mn) of 4,300 and a weight average molecular weight (Mw) of 22,000.

Synthesis of Isocyanate-Modified Polyester Segment (A1):

To 1,000 parts by mass of the above described polyester segment (a1) was added 2,000 parts by mass of ethyl acetate, then, 120 parts by mass of isophorone diisocyanate was added thereto and reacted at 80° C. for 2 hrs. to obtain an isocyanate-modified polyester segment (A1).

Synthesis of Polyester Segment (a2):

Into a reaction vessel fitted with a stirrer and a nitrogen-introducing tube were placed 250 parts by mass of bisphenol A with 2 mole ethylene oxide adduct, 53 parts by mass of ethylene glycol, 200 parts by mass of isophthalic acid, 70 parts by mass of fumaric acid and 3 parts by mass of tetra-isopropyl titanate (0.4% by mass) and reacted at 220° C. under normal pressure for 5 hrs. Further, after reacted under reduced pressure of 1,330 Pa for 4 hrs., the reaction mixture was cooled to 160° C.

Then, 32 parts by mass of phthalic acid anhydride was added thereto and reacted for 2 hrs. to obtain a polyester segment (a2). The polyester segment (a2) exhibited a glass transition point (Tg) of 46° C., a softening point of 103° C., a number average molecular weight (Mn) of 4,000 and a weight average molecular weight (Mw) of 31,000.

Synthesis of Isocyanate-Modified Polyester Segment (A2):

To 1,000 parts by mass of the polyester segment (a2) was added 2,000 parts by mass of ethyl acetate, then, 130 parts by mass of isophorone diisocyanate was added thereto and reacted at 80° C. for 2 hrs. to obtain an isocyanate-modified polyester segment (A2).

Synthesis of Polyester Segment (a3):

Polyester segment (a3) was prepared similarly to the foregoing polyester segment (a1), provided that 2 parts by mass (0.2% by mass) of tetra-n-butyl titanate was replaced by 6 parts by mass (0.6% by mass) of titanium octylene glycol. The polyester segment (a3) exhibited a glass transition point (Tg) of 51° C., a softening point of 105° C., a number average molecular weight (Mn) of 4,000 and a weight average molecular weight (Mw) of 21,000.

Synthesis of Isocyanate-Modified Polyester Segment (A3):

To 1,000 parts by mass of the polyester segment (a3) was added 2,000 parts by mass of ethyl acetate, then, 120 parts by mass of isophorone diisocyanate was added thereto and reacted at 80° C. for 2 hrs. to obtain an isocyanate-modified polyester segment (A3).

Synthesis of Polyester Segment (a4):

Polyester segment (a4) was prepared similarly to the foregoing polyester segment (a1), provided 2.0 parts by mass (0.2% by mass) of tetra-n-butyl titanate was replaced by 2.5 parts by mass (0.25% by mass) of germanium dioxide. The polyester segment (a4) exhibited a glass transition point (Tg) of 50° C., a softening point of 102° C., a number average molecular weight (Mn) of 3,900 and a weight average molecular weight (Mw) of 19,000.

Synthesis of Isocyanate-Modified Polyester Segment (A4):

To 1,000 parts by mass of the polyester segment (a4) was added 2,000 parts by mass of ethyl acetate, then, 120 parts by mass of isophorone diisocyanate was added thereto and reacted at 80° C. for 2 hrs. to obtain an isocyanate-modified polyester segment (A4).

Synthesis of Polyester Segment (a5):

Polyester segment (a5) was prepared similarly to the foregoing polyester segment (a1), provided 2.0 parts by mass (0.2% by mass) of tetra-n-butyl titanate was replaced by 8 parts by mass (0.8% by mass) of trioctyl aluminate. The polyester segment (a5) exhibited a glass transition point (Tg) of 51° C., a softening point of 105° C., a number average molecular weight (Mn) of 4,600 and a weight average molecular weight (Mw) of 22,000.

Synthesis of Isocyanate-Modified Polyester Segment (A5):

To 1,000 parts by mass of the polyester segment (a5) was added 2,000 parts by mass of ethyl acetate, then, 120 parts by mass of isophorone diisocyanate was added thereto and reacted at 80° C. for 2 hrs. to obtain an isocyanate-modified polyester segment (A5).

Synthesis of Comparative Polyester Segment (b1):

Comparative polyester segment (b1) was prepared similarly to the foregoing polyester segment (a1), provided 2.0 parts by mass (0.2% by mass) of tetra-n-butyl titanate was replaced by 2 parts by mass (0.2% by mass) of tributyl tin. The comparative polyester segment (b1) exhibited a glass transition point (Tg) of 48° C., a softening point of 102° C., a number average molecular weight (Mn) of 3,200 and a weight average molecular weight (Mw) of 18,000.

Synthesis of Comparative Isocyanate-Modified Polyester Segment (B1):

To 1,000 parts by mass of the comparative polyester segment (b1) was added 2,000 parts by mass of ethyl acetate, then, 120 parts by mass of isophorone diisocyanate was added thereto and reacted at 80° C. for 2 hrs. to obtain a comparative isocyanate-modified polyester segment (B1).

Synthesis of Comparative Polyester Segment (b2):

Comparative polyester segment (b2) was prepared similarly to the foregoing polyester segment (a4), provided that the amount of germanium dioxide was changed from 2.5 parts by mass (0.5% by mass) to 5 parts by mass (0.5% by mass). The comparative polyester segment (b2) exhibited a glass transition point (Tg) of 49° C., a softening point of 109° C., a number average molecular weight (Mn) of 4,000 and a weight average molecular weight (Mw) of 28,000.

Synthesis of Comparative Isocyanate-Modified Polyester Segment (B2):

To 1,000 parts by mass of the polyester segment (b2) was added 2,000 parts by mass of ethyl acetate, then, 120 parts by mass of isophorone diisocyanate was added thereto and reacted at 80° C. for 2 hrs. to obtain a comparative isocyanate-modified polyester segment (B2).

2. Manufacture of Toner

Manufacture of Toner Bk1:

In a mixing bath fitted with a liquid seal (reflux condenser) and a stirrer were mixed 900 parts by mass of ethyl acetate, 300 parts by mass of isocyanate-modified polyester segment (A1), 15 parts by mass of carbon black, 30 parts by mass of pentaerythritol tetrastearate, 3 parts by mass of cyclic phenol sulfide (3) and 5 parts by mass of isophoronediamine at 20° C. for 2 hrs. to obtain a toner forming material composition.

Into another reaction vessel were placed 1,000 parts by mass of deionized water, 100 parts by mass of methyl ethyl ketone, 60 parts by mass of tricalcium phosphate and 0.3 parts by mass of sodium dodecylbenzenesulfonate and further thereto, the foregoing toner forming material composition was added and dispersed in the form of oil-droplets dispersed in an aqueous medium and having a number average particle diameter of 0.5 μm, while stirring at 30° C. by a TY-type homomixer (produced by Tokushukika Kogyo Co. Ltd.) at 15,000 rpm over a period of 3 min.

Thereafter, the foregoing homomixer was replaced by a conventional stirrer, the temperature was raised to 80° C. with stirring at 300 rpm and stirred for 3 hrs. to perform molecular an elongation reaction to obtain polyester microparticles and coagulation of the obtained polyester microparticles. The coagulated particles exhibited a volume-based median diameter of 6.9 μm. Then, the temperature was raised to 95° C. to remove ethyl acetate. After removal of ethyl acetate continued until ethyl acetate completely disappeared, 150 parts by mass of a concentrated 35% hydrochloric acid was added thereto to dissolve tricalcium phosphate on the toner particle surface.

Subsequently, after washing process was conducted by, repeating operation wherein toner cake formed by solid-liquid separation and dehydration was dispersed again in deionized water and then solid-liquid separation was conducted three times, drying was done at 40° C. for 24 hrs, to obtain toner particles (Bk1).

To the obtained toner particles (Bk1) were added 0.6 parts by mass of a hydrophobic silica and 1.0 part by mass of a hydrophobic titanium oxide and mixed by a Henschel Mixer to obtain a toner (Bk1), in which the toner was mixed at 32° C. by a Henschel Mixer at 35 m/sec for 20 min and passed through a sieve having an aperture of 35 μm.

The toner (Bk1) contains 230 ppm titanium and exhibited a volume-based median diameter of 5.6 μm, an average circularity of 0.968, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Y1):

Toner (Y1) was manufactured similarly to the foregoing toner (Bk1), provided that 15 parts by mass of carbon black was replaced by 8 parts by mass of C.I. Pigment Yellow 74.

The toner (Y1) exhibited a content of titanium element of 230 ppm, a volume-based particle diameter dispersion degree value) of 19, a volume-based median diameter of 5.7 μm, an average circularity of 0.971, a glass transition point (Tg) of 54° C., a softening point of 113° C., a number average molecular eight (Mn) of 8,000 and a weight average molecular weight (Mw) of 34,000.

Manufacture of Toner (M1):

Toner (M1) was manufactured similarly to the foregoing toner (Bk1), provided that 15 parts by mass of carbon black were replaced by 8 parts by mass of C.I. Pigment Red 238.

The toner (M1) exhibited a content of titanium element of 230 ppm, a volume-based median diameter of 5.7 μm, an average circularity of 0.970, a volume-based particle diameter dispersion degree ($CV_{vol}$ value) of 19, glass transition point (Tg) of 54° C., a softening point of 113° C., a number average molecular eight (Mn) of 8,000 and a weight average molecular weight (Mw) of 34,000.

Manufacture of Toner (C1):

Toner (C1) was manufactured similarly to the foregoing toner (Bk1), provided that 15 parts by mass of carbon black were replaced by 8 parts by mass of copper phthalocyanine blue.

The toner (C1) exhibited a content of titanium element of 230 ppm, a volume-based median diameter of 5.7 μm, an average circularity of 0.969, a volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Bk2):

Toner (Bk2) was manufactured similarly to the foregoing toner (Bk1), provided that isocyanate-modified polyester segment (A1) was replaced by isocyanate-modified polyester segment (A2) and cyclic phenol sulfide (3) was replaced by 3 parts by mass of cyclic phenol sulfide (6).

The toner (Bk2) exhibited a content of titanium element of 500 ppm, a volume-based median diameter of 5.6 μM, an average circularity of 0.965, volume-based particle diameter dispersion degree ($CV_{vol}$ value) of 19, a glass transition point (Tg) of 54° C., a softening point of 109° C., a number average molecular eight (Mn) of 7,900 and a weight average molecular weight (Mw) of 58,000.

Manufacture of Toner (Y2):

Toner (Y2) was manufactured similarly to the foregoing toner (Y1), provided that isocyanate-modified polyester segment (A1) was replaced by isocyanate-modified polyester segment (A2) and cyclic phenol sulfide (3) was replaced by 3 parts by mass of cyclic phenol sulfide (6).

The toner (Y2) exhibited a content of titanium element of 500 ppm, a volume-based median diameter of 5.6 μm, an average circularity of 0.966, volume-based particle diameter dispersion degree ($CV_{vol}$ value) of 19, a glass transition point (Tg) of 54° C., a softening point of 109° C., a number average molecular eight (Mn) of 7,900 and a weight average molecular weight (Mw) of 58,000.

Manufacture of Toner (M2):

Toner (M2) was manufactured similarly to the foregoing toner (M1), provided that isocyanate-modified polyester segment (A1) was replaced by isocyanate-modified polyester segment (A2) and cyclic phenol sulfide (3) was replaced by 3 parts by mass of cyclic phenol sulfide (6).

The toner (M2) exhibited a content of titanium element of 500 ppm, a volume-based median diameter of 5.6 μm, an average circularity of 0.968, volume-based particle diameter dispersion degree ($CV_{vol}$ value) of 19, a glass transition point (Tg) of 54° C., a softening point of 109° C., a number average molecular eight (Mn) of 7,900 and a weight average molecular weight (Mw) of 58,000.

Manufacture of Toner (C2):

Toner (C2) was manufactured similarly to the foregoing toner (C1), provided that isocyanate-modified polyester segment (A1) was replaced by isocyanate-modified polyester segment (A2) and cyclic phenol sulfide (3) was replaced by 3 parts by mass of cyclic phenol sulfide (6).

The toner (C2) exhibited a content of titanium element of 500 ppm, a volume-based median diameter of 5.6 μm, an average circularity of 0.968, volume-based particle diameter dispersion degree ($CV_{vol}$ value) of 19, a glass transition point (Tg) of 54° C., a softening point of 109° C., a number average molecular eight (Mn) of 7,900 and a weight average molecular weight (Mw) of 58,000.

Manufacture of Toner (Bk3):

Toner (Bk3) was manufactured similarly to the foregoing toner (Bk1), provided that isocyanate-modified polyester segment (A1) was replaced by isocyanate-modified polyester segment (A3) and cyclic phenol sulfide (3) was replaced by 3 parts by mass of cyclic phenol sulfide (9).

The toner (Bk3) exhibited a content of titanium element of 650 ppm, a volume-based median diameter of 5.6 μm, an average circularity of 0.971, volume-based particle diameter dispersion degree ($CV_{vol}$ value) of 19, a glass transition point (Tg) of 58° C., a softening point of 110° C., a number average molecular eight (Mn) of 7,600 and a weight average molecular weight (Mw) of 39,000.

Manufacture of Toner (Y3):

Toner (Y3) was manufactured similarly to the foregoing toner (Y1), provided that isocyanate-modified polyester segment (A1) was replaced by isocyanate-modified polyester segment (A3) and cyclic phenol sulfide (3) was replaced by 3 parts by mass of cyclic phenol sulfide (9).

The toner (Y3) exhibited a content of titanium element of 650 ppm, a volume-based median diameter of 5.6 μm, an average circularity of 0.970, volume-based particle diameter dispersion degree ($CV_{vol}$ value) of 19, a glass transition point (Tg) of 58° C., a softening point of 110° C., a number average molecular eight (Mn) of 7,600 and a weight average molecular weight (Mw) of 39,000.

Manufacture of Toner (M3):

Toner (M3) was manufactured similarly to the foregoing toner (Y1), provided that isocyanate-modified polyester segment (A1) was replaced by isocyanate-modified polyester segment (A3) and cyclic phenol sulfide (3) was replaced by 3 parts by mass of cyclic phenol sulfide (9).

The toner (M3) exhibited a content of titanium element of 650 ppm, a volume-based median diameter of 5.6 μm, an average circularity of 0.969, volume-based particle diameter dispersion degree value) of 19, a glass transition point (Tg) of 58° C., a softening point of 110° C., a number average molecular eight (Mn) of 7,600 and a weight average molecular weight (Mw) of 39,000.

Manufacture of Toner (C3):

Toner (C3) was manufactured similarly to the foregoing toner (C1), provided that isocyanate-modified polyester segment (A1) was replaced by isocyanate-modified polyester segment (A3) and cyclic phenol sulfide (3) was replaced by 3 parts by mass of cyclic phenol sulfide (9).

The toner (C3) exhibited a content of titanium element of 650 ppm, a volume-based median diameter of 5.6 μm, an average circularity of 0.968, volume-based particle diameter dispersion degree ($CV_{vol}$ value) of 19, a glass transition point (Tg) of 58° C., a softening point of 110° C., a number average molecular eight (Mn) of 7,600 and a weight average molecular weight (Mw) of 39,000.

Manufacture of Toner (Bk4):

Toner (Bk4) was manufactured similarly to the foregoing toner (Bk1), provided that isocyanate-modified polyester segment (A1) was replaced by isocyanate-modified polyester segment (A4) and cyclic phenol sulfide (3) was replaced by 5 parts by mass of cyclic phenol sulfide (12).

The toner (Bk4) exhibited a content of germanium element of 1,200 ppm, a volume-based median diameter of 5.6 μm, an average circularity of 0.972, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (Y4):

Toner (Y4) was manufactured similarly to the foregoing toner (Y1), provided that isocyanate-modified polyester segment (A1) was replaced by isocyanate-modified polyester segment (A4) and cyclic phenol sulfide (3) was replaced by 5 parts by mass of cyclic phenol sulfide (12).

The toner (Y4) exhibited a content of germanium element of 1,200 ppm, a volume-based median diameter of 5.6 μm, an average circularity of 0.971, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (M4):

Toner (M4) was manufactured similarly to the foregoing toner (M1), provided that isocyanate-modified polyester segment (A1) was replaced by isocyanate-modified polyester segment (A4) and cyclic phenol sulfide (3) was replaced by 5 parts by mass of cyclic phenol sulfide (12).

The toner (M4) exhibited a content of germanium element of 1,200 ppm, a volume-based median diameter of 5.6 μm, an average circularity of 0.971, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (C4):

Toner (C4) was manufactured similarly to the foregoing toner (C1), provided that isocyanate-modified polyester segment (A1) was replaced by isocyanate-modified polyester segment (A4) and cyclic phenol sulfide (3) was replaced by 5 parts by mass of cyclic phenol sulfide (12).

The toner (C4) exhibited a content of germanium element of 1,200 ppm, a volume-based median diameter of 5.6 μm, an average circularity of 0.968, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (Bk5):

Toner (Bk5) was manufactured similarly to the foregoing toner (Bk1), provided that isocyanate-modified polyester segment (A1) was replaced by isocyanate-modified polyester segment (A5) and cyclic phenol sulfide (3) was replaced by 5 parts by mass of cyclic phenol sulfide (15).

The toner (Bk5) exhibited a content of aluminum element of 400 ppm, a volume-based median diameter of 5.6 μm, an average circularity of 0.967, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (Y5):

Toner (Y5) was manufactured similarly to the foregoing toner (Y1), provided that isocyanate-modified polyester segment (A1) was replaced by isocyanate-modified polyester segment (A5) and cyclic phenol sulfide (3) was replaced by 5 parts by mass of cyclic phenol sulfide (15).

The toner (Y5) exhibited a content of aluminum element of 400 ppm, a volume-based median diameter of 5.6 μm, an average circularity of 0.968, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (M5):

Toner (M5) was manufactured similarly to the foregoing toner (M1), provided that isocyanate-modified polyester segment (A1) was replaced by isocyanate-modified polyester segment (A5) and cyclic phenol sulfide (3) was replaced by 5 parts by mass of cyclic phenol sulfide (15).

The toner (M5) exhibited a content of aluminum element of 400 ppm, a volume-based median diameter of 5.6 μm, an average circularity of 0.969, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (C5):

Toner (C5) was manufactured similarly to the foregoing toner (C1), provided that isocyanate-modified polyester segment (A1) was replaced by isocyanate-modified polyester segment (A5) and cyclic phenol sulfide (3) was replaced by 5 parts by mass of cyclic phenol sulfide (15).

The toner (C5) exhibited a content of aluminum element of 400 ppm, a volume-based median diameter of 5.6 μm, an average circularity of 0.969, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (Bk6):

Toner (Bk6) was manufactured similarly to the foregoing toner (Bk1), provided that 3 parts by mass of cyclic phenol sulfide (3) was replaced by 5 parts by mass of cyclic phenol sulfide (16).

The toner (Bk6) exhibited a content of titanium element of 230 ppm, a volume-based median diameter of 5.8 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Y6):

Toner (Y6) was manufactured similarly to the foregoing toner (Y1), provided that 3 parts by mass of cyclic phenol sulfide (3) was replaced by 5 parts by mass of cyclic phenol sulfide (16).

The toner (Y6) exhibited a content of titanium element of 230 ppm, a volume-based median diameter of 5.7 μm, an average circularity of 0.971, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (M6):

Toner (M6) was manufactured similarly to the foregoing toner (M1), provided that 3 parts by mass of cyclic phenol sulfide (3) was replaced by 5 parts by mass of cyclic phenol sulfide (16).

The toner (M6) exhibited a content of titanium element of 230 ppm, a volume-based median diameter of 5.7 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (C6):

Toner (C6) was manufactured similarly to the foregoing toner (C1), provided that 3 parts by mass of cyclic phenol sulfide (3) was replaced by 5 parts by mass of cyclic phenol sulfide (16).

The toner (C6) exhibited a content of titanium element of 230 ppm, a volume-based median diameter of 5.7 μm, an average circularity of 0.970, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Bk7):

Toner (Bk7) was manufactured similarly to the foregoing toner (Bk1), provided that 3 parts by mass of cyclic phenol sulfide (3) was replaced by 5 parts by mass of cyclic phenol sulfide (22).

The toner (Bk7) exhibited a content of titanium element of 230 ppm, a volume-based median diameter of 5.8 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Y7):

Toner (Y7) was manufactured similarly to the foregoing toner (Y1), provided that 3 parts by mass of cyclic phenol sulfide (3) was replaced by 5 parts by mass of cyclic phenol sulfide (22).

The toner (Y7) exhibited a content of titanium element of 230 ppm, a volume-based median diameter of 5.8 μm, an average circularity of 0.971, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (M7):

Toner (M7) was manufactured similarly to the foregoing toner (M1), provided that 3 parts by mass of cyclic phenol sulfide (3) was replaced by 5 parts by mass of cyclic phenol sulfide (22).

The toner (M7) exhibited a content of titanium element of 230 ppm, a volume-based median diameter of 5.7 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (C7):

Toner (C7) was manufactured similarly to the foregoing toner (C1), provided that 3 parts by mass of cyclic phenol sulfide (3) was replaced by 5 parts by mass of cyclic phenol sulfide (22).

The toner (C7) exhibited a content of titanium element of 230 ppm, a volume-based median diameter of 5.8 μm, an average circularity of 0.970, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Bk8):

Toner (Bk8) was manufactured similarly to the foregoing toner (Bk1), provided that 3 parts by mass of cyclic phenol sulfide (3) was replaced by 4 parts by mass of cyclic phenol sulfide (29).

The toner (Bk8) exhibited a content of titanium element of 230 ppm, a volume-based median diameter of 5.9 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Y8):

Toner (Y8) was manufactured similarly to the foregoing toner (Y1), provided that 3 parts by mass of cyclic phenol sulfide (3) was replaced by 4 parts by mass of cyclic phenol sulfide (29).

The toner (Y8) exhibited a content of titanium element of 230 ppm, a volume-based median diameter of 5.9 μm, an average circularity of 0.971, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (M8):

Toner (M8) was manufactured similarly to the foregoing toner (M1), provided that 3 parts by mass of cyclic phenol sulfide (3) was replaced by 4 parts by mass of cyclic phenol sulfide (29).

The toner (M8) exhibited a content of titanium element of 230 ppm, a volume-based median diameter of 5.9 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (C8):

Toner (C8) was manufactured similarly to the foregoing toner (C1), provided that 3 parts by mass of cyclic phenol sulfide (3) was replaced by 4 parts by mass of cyclic phenol sulfide (29).

The toner (C8) exhibited a content of titanium element of 230 ppm, a volume-based median diameter of 5.9 μm, an average circularity of 0.970, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Bk9):

Toner (Bk9) was manufactured similarly to the foregoing toner (Bk1), provided that 3 parts by mass of cyclic phenol sulfide (3) was replaced by 6 parts by mass of cyclic phenol sulfide (30).

The toner (Bk9) exhibited a content of titanium element of 230 ppm, a volume-based median diameter of 5.8 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Y9):

Toner (Y9) was manufactured similarly to the foregoing toner (Y1), provided that 3 parts by mass of cyclic phenol sulfide (3) was replaced by 6 parts by mass of cyclic phenol sulfide (30).

The toner (Y9) exhibited a content of titanium element of 230 ppm, a volume-based median diameter of 5.9 μm, an average circularity of 0.971, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (M9):

Toner (M9) was manufactured similarly to the foregoing toner (M1), provided that 3 parts by mass of cyclic phenol sulfide (3) was replaced by 6 parts by mass of cyclic phenol sulfide (30).

The toner (M9) exhibited a content of titanium element of 230 ppm, a volume-based median diameter of 5.9 μm, an average circularity of 0.969, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (C9):

Toner (C9) was manufactured similarly to the foregoing toner (C1), provided that 3 parts by mass of cyclic phenol sulfide (3) was replaced by 6 parts by mass of cyclic phenol sulfide (30).

The toner (C9) exhibited a content of titanium element of 230 ppm, a volume-based median diameter of 5.9 μm, an average circularity of 0.970, volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (Bk10):

Toner (Bk10) was manufactured similarly to the foregoing toner (Bk3), provided that 3 parts by mass of cyclic phenol sulfide (9) was replaced by 5 parts by mass of cyclic phenol sulfide (34).

The toner (Bk10) exhibited a content of titanium element of 650 ppm, a volume-based median diameter of 5.5 μm, an average circularity of 0.975, volume-based particle diameter dispersion degree ($CV_{vol}$ value) of 19, a glass transition point (Tg) of 58° C., a softening point of 110° C., a number average molecular eight (Mn) of 7,600 and a weight average molecular weight (Mw) of 39,000.

Manufacture of Toner (Y10):

Toner (Y10) was manufactured similarly to the foregoing toner (Y3), provided that 3 parts by mass of cyclic phenol sulfide (9) was replaced by 5 parts by mass of cyclic phenol sulfide (34).

The toner (Y10) exhibited a content of titanium element of 650 ppm, a volume-based median diameter of 5.6 μm, an average circularity of 0.975, volume-based particle diameter dispersion degree ($CV_{vol}$ value) of 19, a glass transition point (Tg) of 58° C., a softening point of 110° C., a number average molecular eight (Mn) of 7,600 and a weight average molecular weight (Mw) of 39,000.

Manufacture of Toner (M10):

Toner (M10) was manufactured similarly to the foregoing toner (M3), provided that 3 parts by mass of cyclic phenol sulfide (9) was replaced by 5 parts by mass of cyclic phenol sulfide (34).

The toner (M10) exhibited a content of titanium element of 650 ppm, a volume-based median diameter of 5.6 μm, an average circularity of 0.978, volume-based particle diameter dispersion degree ($CV_{vol}$ value) of 19, a glass transition point (Tg) of 58° C., a softening point of 110° C., a number average molecular eight (Mn) of 7,600 and a weight average molecular weight (Mw) of 39,000.

Manufacture of Toner (C10):

Toner (C10) was manufactured similarly to the foregoing toner (C3), provided that 3 parts by mass of cyclic phenol sulfide (9) was replaced by 5 parts by mass of cyclic phenol sulfide (34).

The toner (C10) exhibited a content of titanium element of 650 ppm, a volume-based median diameter of 5.6 μm, an average circularity of 0.976, volume-based particle diameter dispersion degree ($CV_{vol}$ value) of 19, a glass transition point (Tg) of 58° C., a softening point of 110° C., a number average molecular eight (Mn) of 7,600 and a weight average molecular weight (Mw) of 39,000.

Manufacture of Toner (Bk11):

Toner (Bk11) was manufactured similarly to the foregoing toner (Bk4), provided that 5 parts by mass of cyclic phenol sulfide (12) was replaced by 5 parts by mass of cyclic phenol sulfide (40).

The toner (Bk11) exhibited a content of germanium element of 1,200 ppm, a volume-based median diameter of 5.6 μm, an average circularity of 0.972, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (Y11):

Toner (Y11) was manufactured similarly to the foregoing toner (Y4), provided that 5 parts by mass of cyclic phenol sulfide (12) was replaced by 5 parts by mass of cyclic phenol sulfide (40).

The toner (Y11) exhibited a content of germanium element of 1,200 ppm, a volume-based median diameter of 5.6 μm, an average circularity of 0.976, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (M11):

Toner (M11) was manufactured similarly to the foregoing toner (M4), provided that 5 parts by mass of cyclic phenol sulfide (12) was replaced by 5 parts by mass of cyclic phenol sulfide (40).

The toner (M11) exhibited a content of germanium element of 1,200 ppm, a volume-based median diameter of 5.6 μm, an average circularity of 0.976, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (C11):

Toner (C11) was manufactured similarly to the foregoing toner (C4), provided that 5 parts by mass of cyclic phenol sulfide (12) was replaced by 5 parts by mass of cyclic phenol sulfide (40).

The toner (C11) exhibited a content of germanium element of 1,200 ppm, a volume-based median diameter of 5.6 μm, an average circularity of 0.976, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (Bk12):

Toner (Bk12) was manufactured similarly to the foregoing toner (Bk4), provided that 5 parts by mass of cyclic phenol sulfide (12) was replaced by 5 parts by mass of cyclic phenol sulfide (43).

The toner (Bk12) exhibited a content of germanium element of 1,200 ppm, a volume-based median diameter of 5.6 μm, an average circularity of 0.975, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (Y12):

Toner (Y12) was manufactured similarly to the foregoing toner (Y4), provided that 5 parts by mass of cyclic phenol sulfide (12) was replaced by 5 parts by mass of cyclic phenol sulfide (43).

The toner (Y12) exhibited a content of germanium element of 1,200 ppm, a volume-based median diameter of 5.6 μm, an average circularity of 0.978, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (M12):

Toner (M12) was manufactured similarly to the foregoing toner (M4), provided that 5 parts by mass of cyclic phenol sulfide (12) was replaced by 5 parts by mass of cyclic phenol sulfide (43).

The toner (M12) exhibited a content of germanium element of 1,200 ppm, a volume-based median diameter of 5.6 μm, an average circularity of 0.979, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (C12):

Toner (C12) was manufactured similarly to the foregoing toner (C4), provided that 5 parts by mass of cyclic phenol sulfide (12) was replaced by 5 parts by mass of cyclic phenol sulfide (43).

The toner (C12) exhibited a content of germanium element of 1,200 ppm, a volume-based median diameter of 5.6 μm, an average circularity of 0.979, volume-based particle diameter dispersion degree ($CV_{vol}$ value) of 18, a glass transition point (Tg) of 56° C., a softening point of 109° C., a number average molecular eight (Mn) of 6,700 and a weight average molecular weight (Mw) of 34,600.

Manufacture of Toner (Bk13):

Toner (Bk13) was manufactured similarly to the foregoing toner (Bk5), provided that 5 parts by mass of cyclic phenol sulfide (15) was replaced by 4 parts by mass of cyclic phenol sulfide (46).

The toner (Bk13) exhibited a content of aluminum element of 400 ppm, a volume-based median diameter of 5.8 μm, an average circularity of 0.976, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (Y13):

Toner (Y13) was manufactured similarly to the foregoing toner (Y5), provided that 5 parts by mass of cyclic phenol sulfide (15) was replaced by 4 parts by mass of cyclic phenol sulfide (46).

The toner (Y13) exhibited a content of aluminum element of 400 ppm, a volume-based median diameter of 5.8 μm, an average circularity of 0.976, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (M13):

Toner (M13) was manufactured similarly to the foregoing toner (M5), provided that 5 parts by mass of cyclic phenol sulfide (15) was replaced by 4 parts by mass of cyclic phenol sulfide (46).

The toner (M13) exhibited a content of aluminum element of 400 ppm, a volume-based median diameter of 5.8 μm, an average circularity of 0.977, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (C13):

Toner (C13) was manufactured similarly to the foregoing toner (C5), provided that 5 parts by mass of cyclic phenol sulfide (15) was replaced by 4 parts by mass of cyclic phenol sulfide (46).

The toner (C13) exhibited a content of aluminum element of 400 ppm, a volume-based median diameter of 5.6 μm, an average circularity of 0.976, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (Bk14):

Toner (Bk14) was manufactured similarly to the foregoing toner (Bk5), provided that 5 parts by mass of cyclic phenol sulfide (15) was replaced by 4 parts by mass of cyclic phenol sulfide (48).

The toner (Bk14) exhibited a content of aluminum element of 400 ppm, a volume-based median diameter of 5.8 μm, an average circularity of 0.979, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (Y14):

Toner (Y14) was manufactured similarly to the foregoing toner (Y5), provided that 5 parts by mass of cyclic phenol sulfide (15) was replaced by 4 parts by mass of cyclic phenol sulfide (48).

The toner (Y14) exhibited a content of aluminum element of 400 ppm, a volume-based median diameter of 5.8 μm, an average circularity of 0.979, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (M14):

Toner (M14) was manufactured similarly to the foregoing toner (M5), provided that 5 parts by mass of cyclic phenol sulfide (15) was replaced by 4 parts by mass of cyclic phenol sulfide (48).

The toner (M14) exhibited a content of aluminum element of 400 ppm, a volume-based median diameter of 5.8 μm, an average circularity of 0.979, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (C14):

Toner (C14) was manufactured similarly to the foregoing toner (C5), provided that 5 parts by mass of cyclic phenol sulfide (15) was replaced by 4 parts by mass of cyclic phenol sulfide (48).

The toner (C14) exhibited a content of aluminum element of 400 ppm, a volume-based median diameter of 5.8 μm, an average circularity of 0.979, volume-based particle diameter dispersion degree ($CV_{vol}$ value) of 19, a glass transition point (Tg) of 59° C., a softening point of 112° C., a number average molecular eight (Mn) of 8,300 and a weight average molecular weight (Mw) of 38,000.

Manufacture of Toner (bk1):

Toner (bk1) for comparison was manufactured similarly to the foregoing toner (Bk1), provided that isocyanate-modified polyester segment (A1) was replaced by isocyanate-modified polyester segment (B1).

The toner (bk1) exhibited a content of tin element of 800 ppm a volume-based median diameter of 5.6 μm, an average circularity of 0.974, a volume-based particle diameter dispersion degree ($CV_{vol}$ value) of 19, a glass transition point (Tg) of 56° C., a softening point of 110° C., a number average molecular eight (Mn) of 6,000 and a weight average molecular weight (Mw) of 32,000.

Manufacture of Toner (y1):

Toner (y1) for comparison was manufactured similarly to the foregoing toner (Y1), provided that isocyanate-modified polyester segment (A1) was replaced by isocyanate-modified polyester segment (B1).

The toner (y1) exhibited a content of tin element of 800 ppm a volume-based median diameter of 5.6 μm, an average circularity of 0.974, a volume-based particle diameter dispersion degree ($CV_{vol}$ value) of 19, a glass transition point (Tg) of 56° C., a softening point of 110° C., a number average molecular eight (Mn) of 6,000 and a weight average molecular weight (Mw) of 32,000.

Manufacture of Toner (m1):

Toner (m1) for comparison was manufactured similarly to the foregoing toner (Y1), provided that isocyanate-modified polyester segment (A1) was replaced by isocyanate-modified polyester segment (B1).

The toner (m1) exhibited a content of tin element of 800 ppm a volume-based median diameter of 5.6 μm, an average circularity of 0.972, a volume-based particle diameter dispersion degree ($CV_{vol}$ value) of 19, a glass transition point (Tg) of 56° C., a softening point of 110° C., a number average molecular eight (Mn) of 6,000 and a weight average molecular weight (Mw) of 32,000.

Manufacture of Toner (c1):

Toner (c1) for comparison was manufactured similarly to the foregoing toner (C1), provided that isocyanate-modified polyester segment (A1) was replaced by isocyanate-modified polyester segment (B1).

The toner (c1) exhibited a content of tin element of 800 ppm a volume-based median diameter of 5.6 μm, an average circularity of 0.971, a volume-based particle diameter dispersion degree ($CV_{vol}$ value) of 19, a glass transition point (Tg) of 56° C., a softening point of 110° C., a number average molecular eight (Mn) of 6,000 and a weight average molecular weight (Mw) of 32,000.

Manufacture of Toner (bk2):

Toner (bk2) for comparison was manufactured similarly to the foregoing toner (Bk1), provided that isocyanate-modified polyester segment (A1) was replaced by isocyanate-modified polyester segment (B2).

The toner (bk2) exhibited a content of germanium element of 1,600 ppm a volume-based median diameter of 5.6 μm, an average circularity of 0.974, a volume-based particle diameter dispersion degree ($CV_{vol}$ value) of 19, a glass transition point (Tg) of 59° C., a softening point of 112° C., a number average molecular eight (Mn) of 7,000 and a weight average molecular weight (Mw) of 36,000.

Manufacture of Toner (y2):

Toner (y2) for comparison was manufactured similarly to the foregoing toner (Y1), provided that isocyanate-modified polyester segment (A1) was replaced by isocyanate-modified polyester segment (B2).

The toner (y2) exhibited a content of germanium element of 1,600 ppm a volume-based median diameter of 5.6 μm, an average circularity of 0.974, a volume-based particle diameter dispersion degree ($CV_{vol}$ value) of 19, a glass transition point (Tg) of 59° C., a softening point of 112° C., a number average molecular eight (Mn) of 7,000 and a weight average molecular weight (Mw) of 36,000.

Manufacture of Toner (m2):

Toner (m2) for comparison was manufactured similarly to the foregoing toner (M1), provided that isocyanate-modified polyester segment (A1) was replaced by isocyanate-modified polyester segment (B2).

The toner (m2) exhibited a content of germanium element of 1,600 ppm a volume-based median diameter of 5.6 μm, an average circularity of 0.972, a volume-based particle diameter dispersion degree ($CV_{vol}$ value) of 19, a glass transition point (Tg) of 59° C., a softening point of 112° C., a number average molecular eight (Mn) of 7,000 and a weight average molecular weight (Mw) of 36,000.

Manufacture of Toner (c2):

Toner (c2) for comparison was manufactured similarly to the foregoing toner (C1), provided that isocyanate-modified polyester segment (A1) was replaced by isocyanate-modified polyester segment (B2).

The toner (c2) exhibited a content of germanium element of 1,600 ppm a volume-based median diameter of 5.6 μm, an average circularity of 0.971, a volume-based particle diameter dispersion degree ($CV_{vol}$ value) of 19, a glass transition point (Tg) of 59° C., a softening point of 112° C., a number average molecular eight (Mn) of 7,000 and a weight average molecular weight (Mw) of 36,000.

Manufacture of Toner (bk3):

Toner (bk3) for comparison was manufactured similarly to the foregoing toner (Bk1), provided that 3 parts by mass of cyclic phenol sulfide (3) was replaced by 3 parts by mass of calixarene compound with n=4, X=$CH_2$ and Y—OH.

The toner (bk3) exhibited a content of titanium element of 230 ppm a volume-based median diameter of 5.8 μm, an average circularity of 0.969a volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (y3):

Toner (y3) for comparison was manufactured similarly to the foregoing toner (Y1), provided that 3 parts by mass of cyclic phenol sulfide (3) was replaced by 3 parts by mass of calixarene compound with n=4, X=$CH_2$ and Y—OH.

The toner (y3) exhibited a content of titanium element of 230 ppm a volume-based median diameter of 5.9 μm, an average circularity of 0.971, a volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (m3):

Toner (m3) for comparison was manufactured similarly to the foregoing toner (Y1), provided that 3 parts by mass of cyclic phenol sulfide (3) was replaced by 3 parts by mass of calixarene compound with n=4, X=$CH_2$ and Y—OH.

The toner (m3) exhibited a content of titanium element of 230 ppm a volume-based median diameter of 5.9 μm, an average circularity of 0.969, a volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

Manufacture of Toner (c3):

Toner (c3) for comparison was manufactured similarly to the foregoing toner (C1), provided that 3 parts by mass of cyclic phenol sulfide (3) was replaced by 3 parts by mass of calixarene compound with n=4, X=$CH_2$ and Y—OH.

The toner (c3) exhibited a content of titanium element of 230 ppm a volume-based median diameter of 5.9 μm, an average circularity of 0.970, a volume-based particle diameter dispersion degree ($CV_{vol}$ value) of 19, a glass transition point (Tg) of 54° C., a softening point of 113° C., a number average molecular eight (Mn) of 8,000 and a weight average molecular weight (Mw) of 34,000.

4. Manufacture of Developer:

Manufacture of Carrier:

Manganese-magnesium ferrite particles having a weight average particle diameter of 50 μM were spray-coated with a coating agent composed of 85 parts by mass (solids) of silicone resin (oxime-hardening type, toluene solution), 10 parts by mass of γ-aminopropyltrimethoxysilane (coupling agent), 3 parts by mass of alumina particles (particle diameter of 100 nm) and 2 parts by mass of carbon black, were subjected to sintering at 190° C. for 6 hrs. and then cooled to normal temperature to obtain a resin-coated carrier. The average thickness of the resin coat was 0.2 μm.

Manufacture of Developer:

Using a V-type mixing machine, 94 parts by mass of the thus manufactured carrier was mixed with 6 parts by mass of each of manufactured toners (Bk1) through (Bk14), (Y1) through (Y14), (M1) through (M14) and (C1) through (C14), and toners for comparison (bk1) through (bk3), (y1) through (y3), (m1) through (m3), and (c1) through (c3), to manufacture developers (Bk1) through (Bk14), (Y1) through (Y14), (M1) through (M14) and (C1) through (C14), and developers for comparison (bk1) through (bk3), (y1) through (y3), (m1) through (m3), and (c1) through (c3). In the mixing treatment, mixing was stopped when an electrostatic charge reached 20-23 μC/g and the developer was discharged into a polyethylene pot.

5. Evaluation of Monochromatic Image:

Using each of black, yellow, magenta and cyan developers described above was set to make a combination shown in Table 2. Example 1 through 14 is a combination of developers composed of toner according to the invention, and Comparative Examples 1 through 3 is a combination of developers composed of toner fallen outside of the invention.

TABLE 2

| | Developer Combination | Metal Element Species | Metal Element Content (ppm) | Cyclic phenol compound No. | Cyclic phenol compound X |
|---|---|---|---|---|---|
| Example 1 | Bk1, Y1, M1, C1 | Ti | 230 | 3 | S |
| Example 2 | Bk2, Y2, M2, C2 | Ti | 500 | 6 | S |
| Example 3 | Bk3, Y3, M3, C3 | Ti | 650 | 9 | S |
| Example 4 | Bk4, Y4, M4, C4 | Ge | 1,200 | 12 | S |
| Example 5 | Bk5, Y5, M5, C5 | Ge | 400 | 15 | SO |
| Example 6 | Bk6, Y6, M6, C6 | Ti | 230 | 16 | SO |
| Example 7 | Bk7, Y7, M7, C7 | Ti | 230 | 22 | SO |
| Example 8 | Bk8, Y8, M8, C8 | Ti | 230 | 29 | $SO_2$ |
| Example 9 | Bk9, Y9, M9, C9 | Ti | 230 | 30 | $SO_2$ |
| Example 10 | Bk10, Y10, M10, C10 | Ti | 650 | 34 | $SO_2$ |
| Example 11 | Bk11, Y11, M11, C11 | Ge | 1,200 | 40 | S |
| Example 12 | Bk12, Y12, M12, C12 | Ge | 1,200 | 43 | SO |
| Example 13 | Bk13, Y13, M13, C13 | Al | 400 | 46 | S |
| Example 14 | Bk14, Y41, M14, C14 | Al | 400 | 48 | S |
| Comparative Example 1 | bk1, y1, m1, c1 | Sn | 80 | 3 | S |
| Comparative Example 2 | bk2, y2, m2, c2 | Ge | 1,600 | 3 | S |

TABLE 2-continued

| | Developer Combination | Metal Element Species | Metal Element Content (ppm) | Cyclic phenol compound No. | Cyclic phenol compound X |
|---|---|---|---|---|---|
| Comparative Example 3 | bk3, y3, m3, c3 | Ti | 230 | Note 1) | — |

Note 1) compound having X═$CH_2$, Y═H and X═H in Compound No. 3.

(2) Evaluation

Combination of developers shown in above described Table 2 was installed in a digital copier, on the market, bizhub C500 (produced by Konica Minolta Corp.), and the following tests were conducted under high temperature and high humidity (35° C., 85% RH).

Evaluation of Monochrome Image Density

A black solid image (5×5 cm) was prepared by using black developers [Bk1] through [Bk14] and [bk1] through [bk3]. A reflection density of the black solid image was measured via a reflection densitometer, RD-918 (produced by Macbeth Corp.). The reflection density was represented by a relative value, based on the reflection density of paper being 0. Further, 100,000 sheets of the character image having 1% pixel ratio were printed in a one-sheet intermittent mode in which after one sheet was printed, stoppage was taken for 5 sec. and the 10,000th sheet was evaluated with respect to image density and fog density. And further, it was kept standing for one day and night under high temperature and high humidity, then solid white image and solid black image were printed and fog density and image density were evaluated.

Evaluation of Color Reproduction Area of Full Color Image

Using developers (Y1) through (C14) and developers for comparison (y1)-(c3), solid images (2×2 cm) of yellow (Y), magenta (M), cyan (C), blue (B), green (G) and red (R), and the respective color regions were each measured and represented in the a*-b* coordinates.

The evaluation was conducted by forming images described above at initial stage and after 100,000 prints and an area of a color reproducible region was determined and represented by a relative value, based on the area of a color reproduction region constituted by the respective color region of Y/M/C/R/G/B of corresponding to Japan Color for printing, being 100. Prints of 100,000 sheets were conducted by printing image having 5% pixel ratio each of Y/M/C/Bk in a one-sheet intermittent mode The result is shown in Table 3.

TABLE 3

| | Monochrome Image | | | | | | Full Color Image (Color Area) | |
|---|---|---|---|---|---|---|---|---|
| | Initial | | After 100,000 prints | | After standing 24 hours after 100,000 prints | | | |
| Example No. | Fog Density | Image Density | Fog Density | Image Density | Fog Density | Image Density | Initial | After 100,000 prints |
| Example 1 | 0.000 | 1.42 | 0.001 | 1.41 | 0.002 | 1.43 | 104 | 103 |
| Example 2 | 0.000 | 1.42 | 0.001 | 1.41 | 0.002 | 1.43 | 104 | 103 |
| Example 3 | 0.001 | 1.41 | 0.001 | 1.40 | 0.003 | 1.43 | 103 | 102 |
| Example 4 | 0.001 | 1.42 | 0.002 | 1.41 | 0.003 | 1.44 | 103 | 102 |
| Example 5 | 0.001 | 1.41 | 0.001 | 1.41 | 0.002 | 1.44 | 103 | 101 |
| Example 6 | 0.001 | 1.41 | 0.001 | 1.41 | 0.002 | 1.43 | 102 | 102 |
| Example 7 | 0.000 | 1.42 | 0.001 | 1.41 | 0.003 | 1.42 | 103 | 102 |
| Example 8 | 0.001 | 1.42 | 0.001 | 1.41 | 0.002 | 1.43 | 103 | 102 |
| Example 9 | 0.001 | 1.42 | 0.001 | 1.41 | 0.002 | 1.43 | 102 | 102 |
| Example 10 | 0.001 | 1.41 | 0.002 | 1.41 | 0.003 | 1.43 | 103 | 102 |
| Example 11 | 0.001 | 1.42 | 0.002 | 1.41 | 0.003 | 1.43 | 103 | 101 |

TABLE 3-continued

| | Monochrome Image | | | | | | | |
|---|---|---|---|---|---|---|---|---|
| | Initial | | After 100,000 prints | | After standing 24 hours after 100,000 prints | | Full Color Image (Color Area) | |
| Example No. | Fog Density | Image Density | Fog Density | Image Density | Fog Density | Image Density | Initial | After 100,000 prints |
| Example 12 | 0.000 | 1.45 | 0.002 | 1.41 | 0.002 | 1.42 | 103 | 101 |
| Example 13 | 0.001 | 1.41 | 0.002 | 1.41 | 0.002 | 1.41 | 103 | 101 |
| Example 14 | 0.001 | 1.41 | 0.002 | 1.41 | 0.002 | 1.42 | 103 | 101 |
| Comparative Example 1 | 0.001 | 1.41 | 0.009 | 1.30 | 0.010 | 1.31 | 101 | 92 |
| Comparative Example 2 | 0.001 | 1.42 | 0.010 | 1.29 | 0.011 | 1.29 | 101 | 91 |
| Comparative Example 3 | 0.001 | 1.41 | 0.008 | 1.31 | 0.010 | 1.31 | 100 | 91 |

The result shown in Table 3 exhibits that sufficient image density was obtained in the monochrome image as well as broad color reproduction was obtained in the Examples 1 through 14. On the other side, sufficient image density was not obtained in the monochrome image as well as broad color reproduction was not obtained in the Comparative Examples 1 through 3.

The invention claimed is:

1. A toner composed of toner particles containing at least a binding resin containing a polyester resin and a colorant, wherein the toner contains 10 ppm to 1500 ppm of a metal element selected from titanium, germanium and aluminum, and cyclic phenol sulfide represented by Formula (1)

Formula (1)

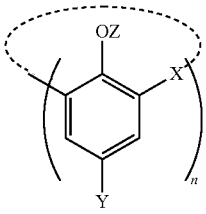

in the formula, X is a sulfur atom, an SO or $SO_2$ group; Z is a hydrogen atom, an alkyl group, a substituted alkyl group, an aralkyl group, an acyl group or an alkoxycarbonyl group; Y is a hydrocarbon group, a halogenated hydrocarbon group, a halogen atom, —$SO_4R^1$ group or —$SO_3R^2$ group, wherein $R^1$ and $R^2$ is a hydrogen atom, a hydrocarbon group or a metal atom, and plural Ys may be same or different; and n is an integer of 3 to 9, and wherein the toner particles have an average circularity of 0.950 to 0.980, a volume-based median diameter of 4.5 to 8.0 μm and a volume-based particle diameter dispersion degree ($CV_{vol}$ value) of 15 to 25.

2. The toner described in claim 1 wherein the metal element is contained in a dispersion state in the binding resin composing toner particles.

3. The toner described in claim 1, wherein n is an integer of 4 to 6.

4. The toner described in claim 1 wherein the cyclic phenol sulfide represented by Formula (1) is thiacalixarene.

5. The toner described in claim 1 wherein the cyclic phenol sulfide represented by Formula (1) is sulfinyl thiacalixarene.

6. The toner described in claim 1 wherein the cyclic phenol sulfide represented by Formula (1) is sulfonyl thiacalixarene.

7. The toner described in claim 1, wherein a volume-based particle diameter dispersion degree ($CV_{vol}$ value) of 15 to 22.

8. The toner described in claim 1, wherein the toner particles have an average circularity of 0.955 to 0.975.

9. The toner described in claim 1, wherein a glass transition point of the polyester resin is from 30 to 60° C.

10. The toner described in claim 9, wherein a glass transition point of the polyester resin is from 35 to 54° C.

11. The toner described in claim 1, wherein a softening point of the polyester resin is from 70 to 130° C.

12. The toner described in claim 11, wherein a softening point of the polyester resin is from 80 to 120° C.

13. The toner described in claim 1, wherein weight average molecular weight of the polyester resin is from 5,000 to 500,000.

14. The toner described in claim 13, wherein weight average molecular weight of the polyester resin is from 10,000 to 100,000.

15. The toner described in claim 1, wherein number average molecular weight of the polyester resin is from 3,500 to 400,000.

16. The toner described in claim 15, wherein number average molecular weight of the polyester resin is from 7,000 to 80,000.

* * * * *